US008135305B2

(12) United States Patent
Kotsuka et al.

(10) Patent No.: US 8,135,305 B2
(45) Date of Patent: Mar. 13, 2012

(54) IMAGE FORMING APPARATUS

(75) Inventors: Hideki Kotsuka, Suntou-gun (JP); Kazufumi Muto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 654 days.

(21) Appl. No.: 12/250,866

(22) Filed: Oct. 14, 2008

(65) Prior Publication Data

US 2009/0116869 A1 May 7, 2009

(30) Foreign Application Priority Data

Oct. 18, 2007 (JP) ..... 2007-271237
Sep. 24, 2008 (JP) ..... 2008-243921

(51) Int. Cl.
*G03G 15/00* (2006.01)
*G03G 15/01* (2006.01)
*G03G 21/00* (2006.01)

(52) U.S. Cl. ..... 399/111

(58) Field of Classification Search ..... 399/110, 399/111, 112
See application file for complete search history.

(56) References Cited

U.S. PATENT DOCUMENTS 6,157,792 A 12/2000 Mori et al. ..... 399/24
6,404,996 B1 6/2002 Mori et al. ..... 399/24
6,571,073 B1 5/2003 Suzuki et al. ..... 399/116
7,024,133 B2 4/2006 Nagashima et al. ..... 399/111
7,116,925 B2 * 10/2006 Yamaguchi ..... 399/111
7,336,916 B2 * 2/2008 Jung et al. ..... 399/111
7,447,467 B2 * 11/2008 Kamimura et al. ..... 399/119
7,480,474 B2 1/2009 Muto ..... 399/175
7,715,746 B2 * 5/2010 Tanabe et al. ..... 399/90
7,715,752 B2 * 5/2010 Sakurai et al. ..... 399/110
7,890,012 B2 * 2/2011 Koishi et al. ..... 399/90
2009/0028601 A1 1/2009 Mizuno et al. ..... 399/111

FOREIGN PATENT DOCUMENTS

JP 08016070 A * 1/1996
JP 2004-212986 7/2004

* cited by examiner

*Primary Examiner* — David Gray
*Assistant Examiner* — Fred L Braun
(74) *Attorney, Agent, or Firm* — Fitzpatrick, Cella, Harper & Scinto

(57) ABSTRACT

An image forming apparatus detachably mounts a cartridge and forms an image on a recording material. The apparatus includes a cartridge positioning portion, a movable member movable between a first position for positioning the cartridge to the positioning portion when the cartridge is mounted to a main assembly of the apparatus, and a retracted position, for permitting cartridge main-assembly mounting in a cartridge longitudinal direction. The movable member has an urging member urging the cartridge to the positioning portion when the movable member takes the first position. Also provided is a guiding member movable relative to the movable member to take a guide position guiding the cartridge when the movable member takes the retracted position and a position retracted from the guide position away from the cartridge when the movable member takes the first position.

15 Claims, 18 Drawing Sheets

IMAGE FORMING APPARATUS

FIELD OF THE INVENTION AND RELATED ART

The present invention relates to an image forming apparatus, having a main assembly thereof to which a cartridge is detachably mountable, for forming an image on a recording medium.

Herein, the image forming apparatus refers to an apparatus for forming an image on a recording medium (such as recording paper or an OHP sheet) by using an electrophotographic image forming method. Examples of the image forming apparatus may include an electrophotographic copying machine, an electrophotographic printer (e.g., a laser beam printer, an LED printer, etc.), a facsimile machine, and a word processor.

The cartridge can be mounted to and demounted from the apparatus main assembly by a user by himself. Therefore, maintenance of the image forming apparatus can be performed by the user by himself without relying on a service person.

The cartridge (process cartridge) is, in the case of the electrophotographic image forming apparatus, prepared by integrally forming an electrophotographic photosensitive member as an image bearing member and image forming process means acting on the electrophotographic photosensitive member into a cartridge, which is detachably mountable to the main assembly of the image forming apparatus. The image forming process means is at least one of, e.g., charging means for electrically charging the photosensitive member uniformly, developing means for developing an electrostatic latent image formed on the photosensitive member, cleaning means for removing toner remaining on the photosensitive member after toner image transfer, and the like. The (apparatus) main assembly is an image forming apparatus portion excluding the process cartridge.

As the image forming apparatus as described above, it is possible to use a tandem-type color electrophotographic apparatus using a plurality of cartridges for forming color component images of, e.g., yellow, magenta, cyan, black, and the like. The color electrophotographic apparatus may include a color electrophotographic copying machine, a color electrophotographic printer (a color laser printer, a color LED printer, etc.), and the like.

In Japanese Laid-Open Patent Application 2004-212986, as a mounting/demounting constitution of four cartridges (photosensitive member units) with respect to an apparatus main assembly, the following constitution is described.

That is, when the respective process cartridges are mounted to an image forming apparatus main assembly, a guide is positioned so that an image bearing member does not contact an intermediary transfer belt (member). Then, after the respective process cartridges are mounted to the guide, the image bearing member is brought into contact with the intermediary transfer belt (member) by upward movement of the guide.

However, at a rear portion of each of supporting surfaces, a bulging portion upwardly projecting from each of the supporting surface is provided. Then, each of the process cartridges rides on an associated bulging portion after it enters the inside of the image forming apparatus main assembly and an engaging portion thereof exits from a vertical guiding portion. Then, each process cartridge is moved upwardly, so that the image bearing member thereof can contact a surface of the intermediary transfer belt. That is, in order to ride on the bulging portion, each process cartridge is guided by the vertical guiding portion with a spacing while being moved upwardly from the associated supporting surface by a predetermined amount and so that the image bearing member does not contact the intermediary transfer belt. Therefore, the predetermined amount and the spacing affects the height of the image forming apparatus main assembly.

SUMMARY OF THE INVENTION

A principal object of the present invention is to provide an image forming apparatus of a demountable cartridge type in which space saving of a mounting and demounting mechanism of the cartridge is realized and the operating force provided by a user necessary for a mounting and demounting operation is decreased to improve operability for the user.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment

<General Schematic Structure of Image Forming Apparatus>

Figure 1:
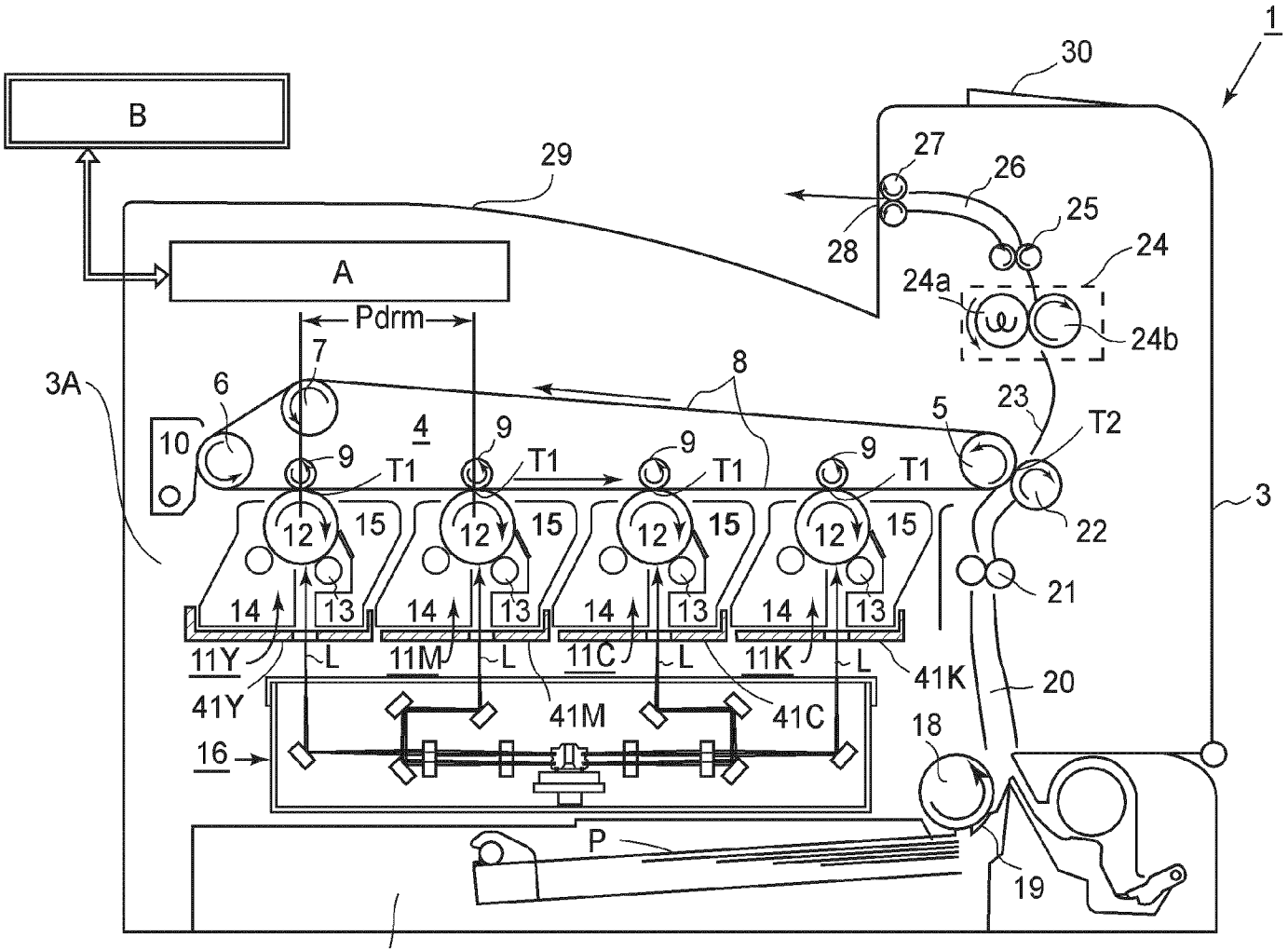
FIG. 1 is a schematic longitudinal front view of an image forming apparatus in First Embodiment.

FIG. 1 is a schematic longitudinal front view of an image forming apparatus of this embodiment. This image forming apparatus is an electrophotographic image forming apparatus in which an image is formed on a recording medium by detachably mounting a process cartridge including an electrophotographic photosensitive drum as an image bearing member and image forming process means acting on the photosensitive drum to a main assembly of the image forming apparatus. In this embodiment, four process cartridges 11Y, 11M, 11C and 11K are detachably mounted to an apparatus main assembly 3 of the image forming apparatus. FIG. 1 is a schematic longitudinal front view showing an example of an image forming apparatus for forming an image on a recording medium (material) P by using the process cartridges.

Figure 2:
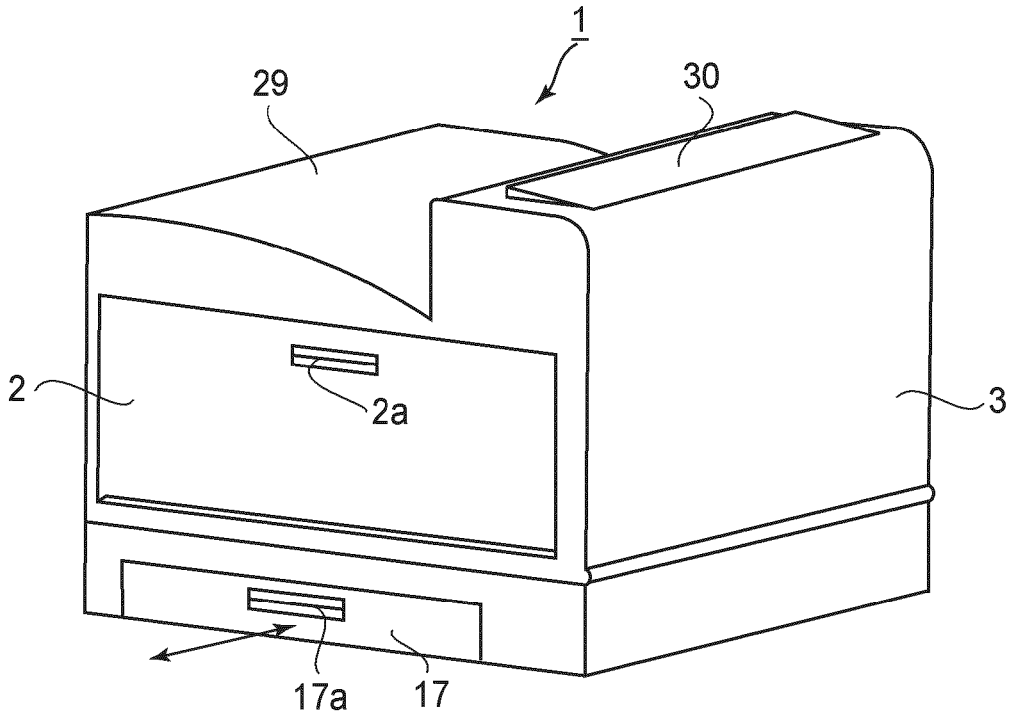
FIG. 2 is a perspective view of an outer appearance of the image forming apparatus.
Figure 3:
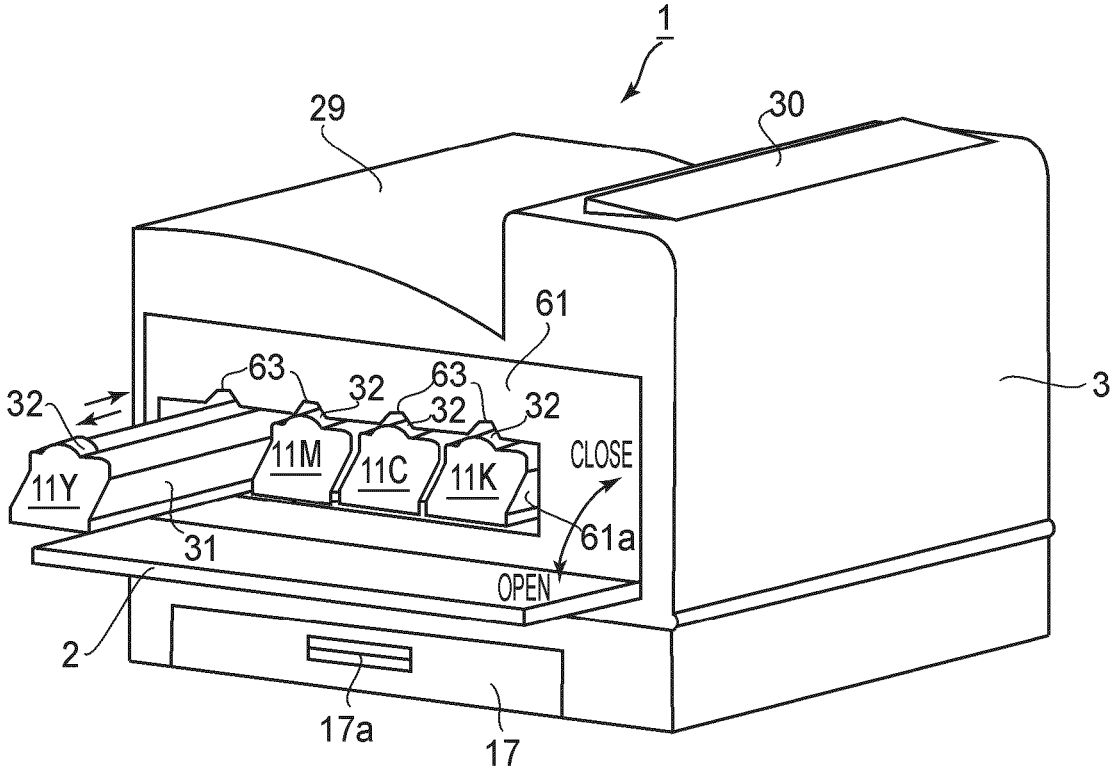
FIG. 3 is a perspective view of an outer appearance of the image forming apparatus in a state in which one of cartridges is being inserted or detached.

FIG. 2 is a perspective view of an outer appearance of this image forming apparatus. FIG. 3 is a perspective view of an outer appearance of the image forming apparatus placed in a state in which one process cartridge 11Y of the four process cartridges is being inserted or detached by opening an openable door 2.

In this embodiment, an image forming apparatus 1 is an electrophotographic full-color printer of the quadruple drum-type (tandem-type) using an intermediary transfer belt 8. This image forming apparatus 1 is capable of outputting a full-color image or a monochromatic image corresponding to information inputted in electrical form from an external host apparatus B communicatably connected to a control circuit portion (CPU) A as control means of the image forming apparatus 1 by forming the image on a recording material P as a recording medium. The host apparatus B is a computer, an image reader, or the like. The control circuit portion A performs sending and receiving of electrical signals with respect to the host apparatus B and image forming process equipment to execute image forming sequence control.

Herein, with respect to the image forming apparatus 1 of this embodiment, a "front side" refers to a side on which the openable door 2 is disposed. A "rear side" refers to a side opposite to the front side. Further, "left (side)" and "right (side)" are those of the image forming apparatus as seen from the front side. The apparatus main assembly is an image forming apparatus portion excluding the process cartridge as described above.

A reference numeral 4 represents an intermediary transfer belt unit. This unit 4 includes an inner secondary transfer roller 5 disposed on a right side in the apparatus, a follower roller 6 disposed on a left side in the apparatus, a tension roller 7 disposed closer to the follower roller 6, and the intermediary transfer belt 8 extended around these three rollers. The intermediary transfer belt 8 (hereinafter referred to as a "belt") is a dielectric member and is a flexible endless apparatus. The above-mentioned three rollers 5, 6 and 7 are disposed in parallel to each other so that the rotational axis directions are a front-rear direction. The tension roller 7 is moved and urged upwardly to add tension to the belt 8. The belt 8 is rotated (rotationally driven) in a counterclockwise direction, as indicated by an arrow in FIG. 1 above the belt 8, at a predetermined speed by rotating the inner secondary transfer roller 5. Inside of a lower side belt portion between the follower roller 6 and the inner secondary transfer roller 5, first to fourth (four) primary transfer rollers 9 are disposed in parallel to each other so that their rotational axis directions are a front-rear direction while keeping a predetermined spacing between adjacent rollers in the order of left to right with respect to a belt movement direction. Outside a belt extending (contact) portion of the follower roller 6, a belt cleaning device 10 for cleaning an outer surface of the belt 8 is disposed.

Below the belt 8, a plurality of the process cartridges (hereinafter referred to as a "cartridge") is arranged in a left-right direction in parallel to each other. In the apparatus of this embodiment, the first to fourth (four) cartridges 11Y, 11M, 11C and 11K are disposed in the order of left to right along a movement direction of the lower side belt portion between the follower roller 6 and the inner secondary transfer roller 5. Each of the cartridges is detachably mounted to the apparatus main assembly 3. A mounting and demounting structure of the cartridge will be described later.

Each cartridge 11Y, 11M, 11C, 11K is an electrophotographic process mechanism having the same constitution and includes a drum-type electrophotographic photosensitive member (hereinafter referred to as a "drum") 12 as an image bearing member on which a transferable image is to be formed. The cartridge 11Y, 11M, 11C, 11K also includes a primary charging device 13, a developing device 14, and a drum cleaning device 15 which are image forming process means acting on the drum 12. The primary charging device 13 is charging means for electrically uniformly charging a surface of the drum 12 to a predetermined polarity and a predetermined potential. A charging roller is used as the primary charging device 13. The developing device 14 is developing means for supplying developer to the drum 12 to visualize an electrostatic latent image formed on the drum surface as a toner image (developer image). The drum cleaning device 15 is cleaning means for cleaning the surface of the drum 12. A cleaning blade is used as the drum cleaning device 15.

The first cartridge 11Y forms a toner image of yellow (Y) on the drum 12 and accommodates toner of yellow (Y) as the developer in the developing device 14. The second cartridge 11M forms a toner image of magenta (M) on the drum 12 and accommodates toner of magenta (M) as the developer in the developing device 14. The third cartridge 11C forms a toner image of cyan (C) on the drum 12 and accommodates toner of cyan (C) as the developer in the developing device 14. The fourth cartridge 11K forms a toner image of black (K) on the drum 12 and accommodates toner of black (K) as the developer in the developing device 14.

The respective cartridges 11Y, 11M, 11C, 11K are disposed in parallel to each other so that rotational axis directions of the drums 12 are the front-rear direction, and the respective upper surfaces of the drums 12 contact a lower surface of the lower side belt portion of the belt 8 between the follower roller 6 and the inner secondary transfer roller 5. The first to fourth primary transfer roller 9 described above are disposed oppositely to the upper surfaces of corresponding drums 12 of the cartridges with an intervening lower side belt portion of the belt 8. In each of the cartridges 12, a contact portion between the drum 12 and the belt 8 is a primary transfer portion T1.

Below the first to fourth cartridges 11Y, 11M, 11C and 11K, a laser scanner unit 16 as exposure means with respect to the drums 12 of the respective cartridges 12 is disposed. This unit is constituted by laser light emitting means for effecting modulated light emission correspondingly to a time-series electric digital pixel signal of image information, a polygonal mirror, an imaging optical system, a reflection mirror, etc.

Below the unit 16, a sheet cassette 17 which accommodates a stack of a recording material P as the recording medium is disposed. This sheet cassette 17 is operated to be inserted into and detached from the image forming apparatus from the front side of the image forming apparatus (front loading). A reference numeral 17*a* (FIG. 2) represents a hand grip portion, for a cassette inserting and detaching operation, provided to a front plate of the sheet cassette 17.

Outside a belt extending (contact) portion of the inner secondary transfer roller 5, an outer secondary transfer roller 22 is disposed. A contact portion between the belt 8 and the outer secondary transfer roller 22 is a secondary transfer portion T2.

An operation for forming a full-color image is as follows. An electric recording image signal as to a full-color image is inputted from the host apparatus B to the control circuit portion A. The control circuit unit A performs required image processing of the inputted recording image signal and drives the first to fourth cartridges 11Y, 11M, 11C and 11K at predetermined control timing. By this drive, each of the drums 12 is rotated in a clockwise direction of an indicated arrow at the same predetermined speed. The charging roller 13 is rotated by the rotation of the drum 12. The belt 8 is rotated, in the counterclockwise direction indicated by the arrow at the same speed as the rotation speed of the drum 12, by the rotation drive of the inner secondary transfer roller 5 as a driving roller. The surface of the rotating drum 12 is electrically charged uniformly to a predetermined polarity and a predetermined potential by the charging roller 13. The charged surface of the drum 12 is subjected to image exposure by the laser scanner unit 16. This unit 16 outputs laser light L modulated correspondingly to the image-processed recording image signal inputted from the control circuit portion A, thus performing scanning exposure of the charged surface of the drum 12. As a result, an electrostatic latent image corresponding to a scanning exposure pattern is formed on the drum surface. The thus formed electrostatic latent image is developed as a toner image by a developing roller 14*a* (FIG. 5A) of the developing device 14.

By the above-described electrophotographic process, in the first cartridge 11Y, a yellow (Y) toner image corresponding to a Y color component image of a full-color image is formed on the surface of the drum 12 with predetermined control timing. In the second cartridge 11M, a magenta (M) toner image corresponding to a M color component image of the full-color image is formed on the surface of the drum 12 with predetermined control timing. In the third cartridge 11C, a cyan (C) toner image corresponding to a C color component image of the full-color image is formed on the surface of the drum 12 with predetermined control timing. In the fourth cartridge 11K, a black (K) toner image corresponding to a K color component image of the full-color image is formed on the surface of the drum 12 with predetermined control timing.

At the primary transfer portion T1 of the first cartridge 11Y, the Y toner image formed on the drum 12 of the cartridge 11Y is primary-transferred onto the rotated belt 8. Next, at the primary transfer portion T1 of the second cartridge 11M, the M toner image formed on the drum 12 of the cartridge 11M is primary-transferred onto the Y toner image on the belt 8 in a superposition manner. Further, in a similar manner, at the respective primary transfer portions T1 of the third and fourth cartridges 11C and 11K, the C toner image and the K toner image are primary-transferred successively onto the belt 8. That is, onto the belt 8, the four color toner images of Y, M, C and K are successively transferred in a predetermined superposition manner (superimposing transfer or multiple transfer), so that an unfixed full-color toner image is synthetically formed. The order of formation of the color toner images transferred onto the belt 8 in the superposition manner is not limited to the above-described order.

At each of the primary transfer portions T1, the primary transfer of the toner image from the drum 12 to the belt 8 is performed in an electrostatic transfer manner by applying a predetermined primary transfer bias from a power source portion (not shown) to the associated primary transfer roller 9.

Further, in each of the cartridges, the surface of the drum 12 after passing through the primary transfer portion is cleaned by being subjected to removal of primary transfer residual toner by a drum cleaning device 15, thus being repeatedly subjected to image formation.

The synthetically formed unfixed toner images for the full-color image in the above-described manner are conveyed by further rotation of the belt 8 to reach the secondary transfer portion T2.

On the other hand, with predetermined control timing, a pick-up roller 18 is driven and separates one sheet of the recording material P from the cassette 17 and feeds the sheet incorporation with a separation pad 19. The fed recording material P is upwardly guided through a vertical feeding path 20 to reach registration rollers 21. Then, the recording material P is timed to the toner image on the belt 8 by the registration rollers and thereafter is conveyed to the secondary transfer portion T2. During a process in which the recording material P is nipped and conveyed at the secondary transfer portion T2, a predetermined secondary transfer bias is applied from a power source portion (not shown) to the outer secondary transfer roller 22, so that the unfixed full-color toner images are collectively secondary-transferred onto the recording material P.

The recording material P coming out of the secondary transfer portion T2 is separated from the belt 8 and is guided by a conveyance guide 23 to be introduced into the fixing unit 24. The fixing unit 24 in this embodiment is a heat-pressure fixing device including, as a fundamental structural member, a roller pair consisting of a heat roller 24*a* and a pressure roller 24*b*. The recording material P is introduced into a fixing nip which is a press-contact portion of the above roller pair 24*a* and 24*b* and is subjected to heat and pressure by being nipped and conveyed in the fixing nip. As a result, the toners of the respective color toner images are melted and color-mixed to be fixed on the surface of the recording material P as a full-color print image (fixed image).

The recording material P coming out of the fixing unit 24 is discharged from a sheet discharging port 28 onto a sheet discharge tray on an upper surface of the apparatus after passing through a first sheet discharging roller pair 25, a conveyance path 26, and a second sheet discharging roller pair 27.

The surface of the belt 8 after the separation of the recording material P is cleaned by being subjected to removal of secondary transfer residual toner by the belt cleaning device 10 during a subsequent rotation process of the belt 8, thus preparing for a next image forming step.

In the case of a monochromatic print mode, only the fourth cartridge 11K for forming the K toner image is operation-controlled. The first to third cartridges 11Y, 11M and 11C are not operation-controlled although the respective drums 12 are rotated.

In the image forming apparatus of this embodiment, the first to fourth cartridges 11Y, 11M, 11C and 11K are disposed below the intermediary transfer belt unit 4, compared with the case where they are disposed above the belt unit 4, a distance between the primary transfer portion T1 for the K toner image and the secondary transfer portion T2 is decreased. As a result, a time from the pick-up of the recording material P to the sheet discharge is reduced.

In each of the first to fourth cartridges 11Y, 11M, 11C, 11K mounted in the apparatus main assembly 3, with the use thereof for image formation, developer (toner) accommodated in the developing device 14 is consumed. For this reason, for example, detecting means (not shown) for detecting a remaining developer amount in each cartridge is provided to the cartridge. In the control circuit portion A, the remaining (developer) amount value detected by the detecting means is compared with a threshold value preset for lifetime-end notice or lifetime-end warning of the cartridge. Then, with respect to the cartridge in which the remaining amount value of the developer is decreased to a remaining amount value less than the threshold value, the lifetime-end notice or the lifetime-end warning with respect to the cartridge is displayed at a display portion provided on an operation panel 30. By the display, a user is urged to prepare a cartridge for exchange or exchange the cartridge, so that a quality of an output image is maintained.

<Cartridge>

Figure 4:
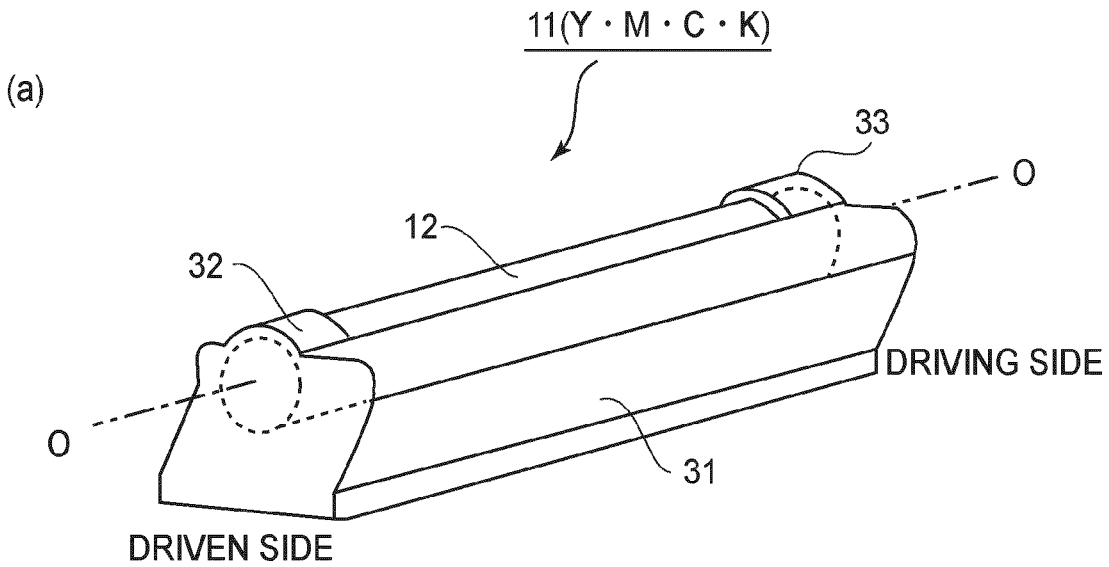
FIG. 4(*a*) is a perspective view of an outer appearance of a cartridge as seen from a driven side, and FIG. 4(*b*) is a perspective view of the outer appearance of the cartridge as seen from a driving side.
Figure 4:
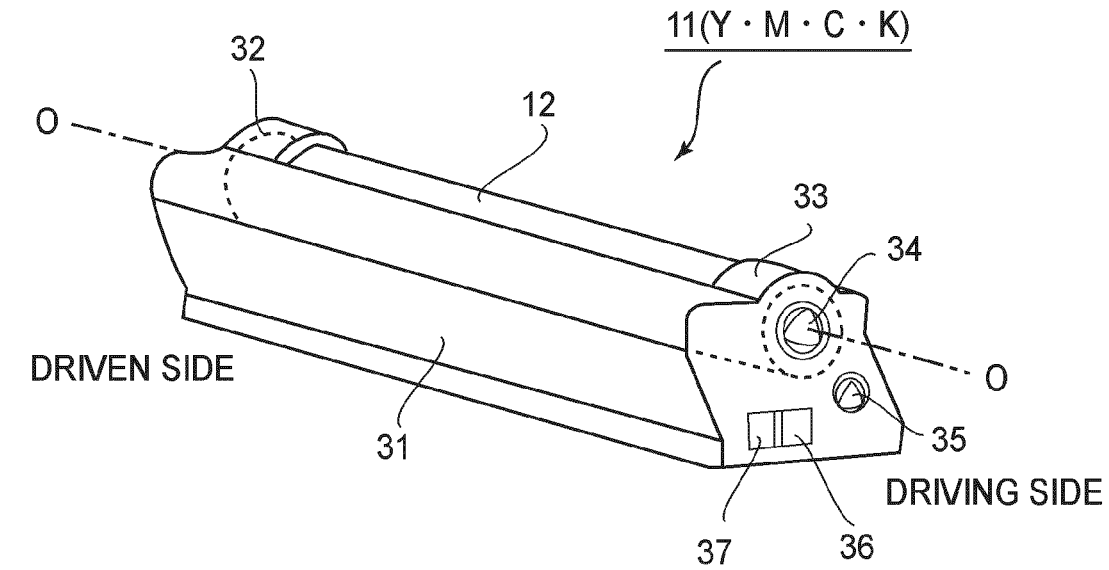
Figure 5A:
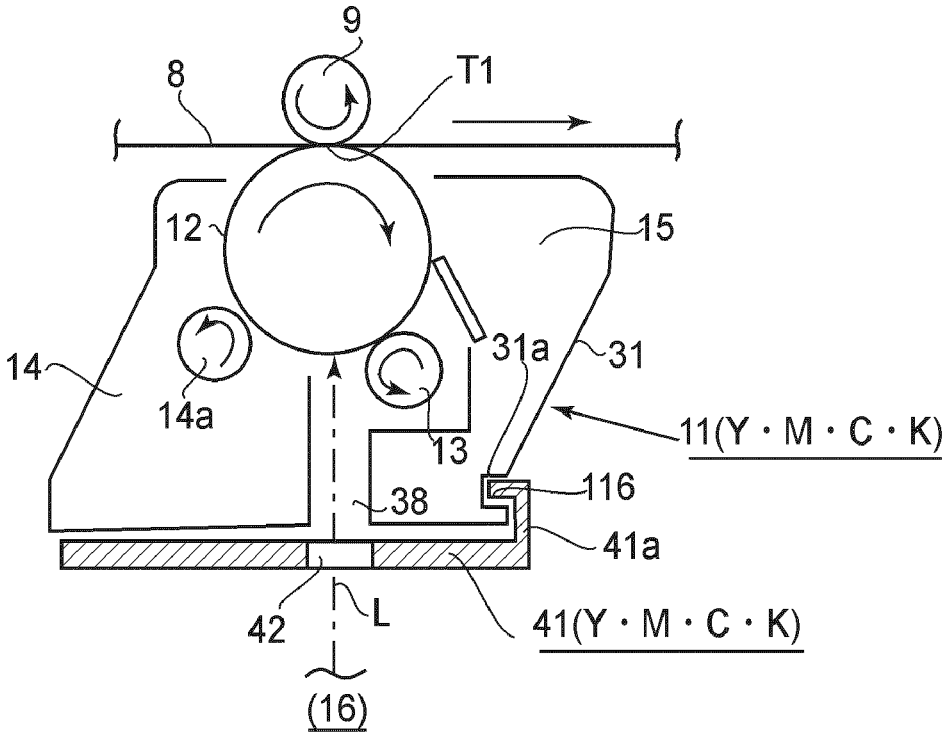
FIG. 5A is a schematic view for illustrating a slit opening, as a laser light incident opening, provided on a cartridge side and a tray side.

Each of the cartridges 11Y, 11M, 11C, 11K has the same constitution and shape. FIG. 4(*a*) is a perspective view of the cartridge 11Y, 11M, 11C, 11K as seen from a driven side and FIG. 4(*b*) is a perspective view of the cartridge 11Y, 11M, 11C, 11K as seen from a driving side. The cartridge 11Y, 11M, 11C, 11K is an assembly with a direction of a rotational axis line O-O as a longitudinal direction thereof, in which as shown in FIGS. 1 and 5A, the drum 12, the charging roller 13 as the primary charging device, the developing device 14, and the drum cleaning device 15 are incorporated in a cartridge frame 31 in a predetermined manner. The drum 12 is rotatably supported and disposed between (shaft) bearing portions 32 and 33 disposed on one end side (driven side) and the other end side (driving side) of the cartridge frame 31. At an end surface on the other side of the cartridge frame 31, a drum driving coupling 34, a developing roller driving coupling 35, and first and second electrical contact portions 36 and 37 are provided. The drum driving coupling 34 is a drum driving force receiving portion for receiving a driving force for rotating the drum 12 from the apparatus main assembly 3 side. The developing roller driving coupling 35 is a developing roller driving force receiving portion for receiving a driving force for rotating the developing roller 14*a* (FIG. 5A) of the developing device 14 from the apparatus main assembly 3 side. The first electrical contact portion 36 is an electrical contact for receiving a charging bias to be supplied from the apparatus main assembly 3 to the charging roller 13. The second electrical contact portion 37 is an electrical contact for receiving a developing bias to be supplied from the apparatus main assembly 3 to the developing roller 14*a*.

In the cartridge 11Y, 11M, 11C, 11K, the side on which the drum driving coupling 34 and the developing roller driving coupling 35*a* are disposed is the driving side and the side opposite from the driving side is the driven side. At a bottom surface of the cartridge 11Y, 11M, 11C, 11K, a slit opening 38 (FIG. 5A) as a laser light incident opening is formed, at a substantially central portion with respect to a bottom surface widthwise direction, along a bottom surface longitudinal direction.

<Cartridge Exchanging Method>

Figure 5B:
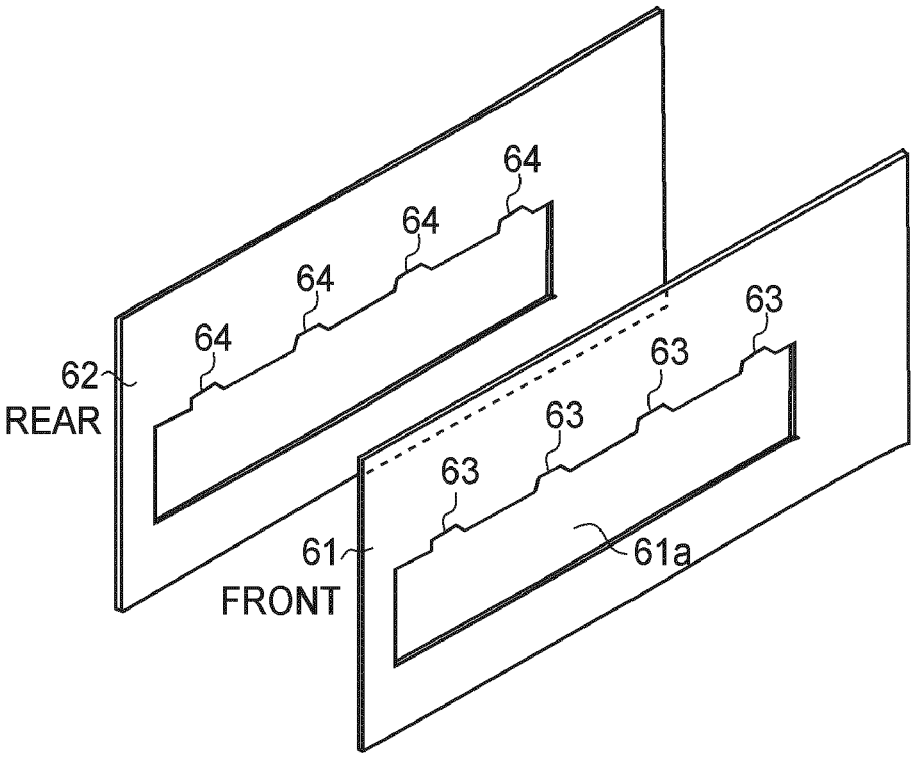
FIG. 5B is a perspective view of a front frame and a rear frame of a main assembly frame constituting a framework of an apparatus main assembly.

In FIG. 5B, reference numerals 61 and 62 represent a front frame and a rear frame of a main assembly frame constituting a framework of the apparatus main assembly 3. As shown in FIG. 1, the intermediary transfer belt unit 4 and the laser scanner unit 16 are positioned, at an upper portion and a lower portion which are located between the opposing front frame 61 and rear frame 62, by a positioning portion, a portion to be positioned, and a fixing member.

Further, a space portion between the front frame 61 and the rear frame 62 and between the intermediary transfer belt unit 4 and the laser scanner unit 16 is a cartridge accommodating portion 3A.

In the accommodating portion 3A, trays (41Y, 41M, 41C, 41K) are movably provided. Each tray 41Y, 41M, 41C, 41K holds the cartridge 11Y, 11M, 11C, 11K and is capable of taking a first position in which the cartridge 11Y, 11M, 11C, 11K is positioned in the apparatus main assembly 3 (FIG. 7) and a second position in which the cartridge 11Y, 11M, 11C, 11K is detachably mountable to the apparatus main assembly 3 by moving the tray 41Y, 41M, 41C, 41K away from the first position (FIG. 8).

Figure 6:
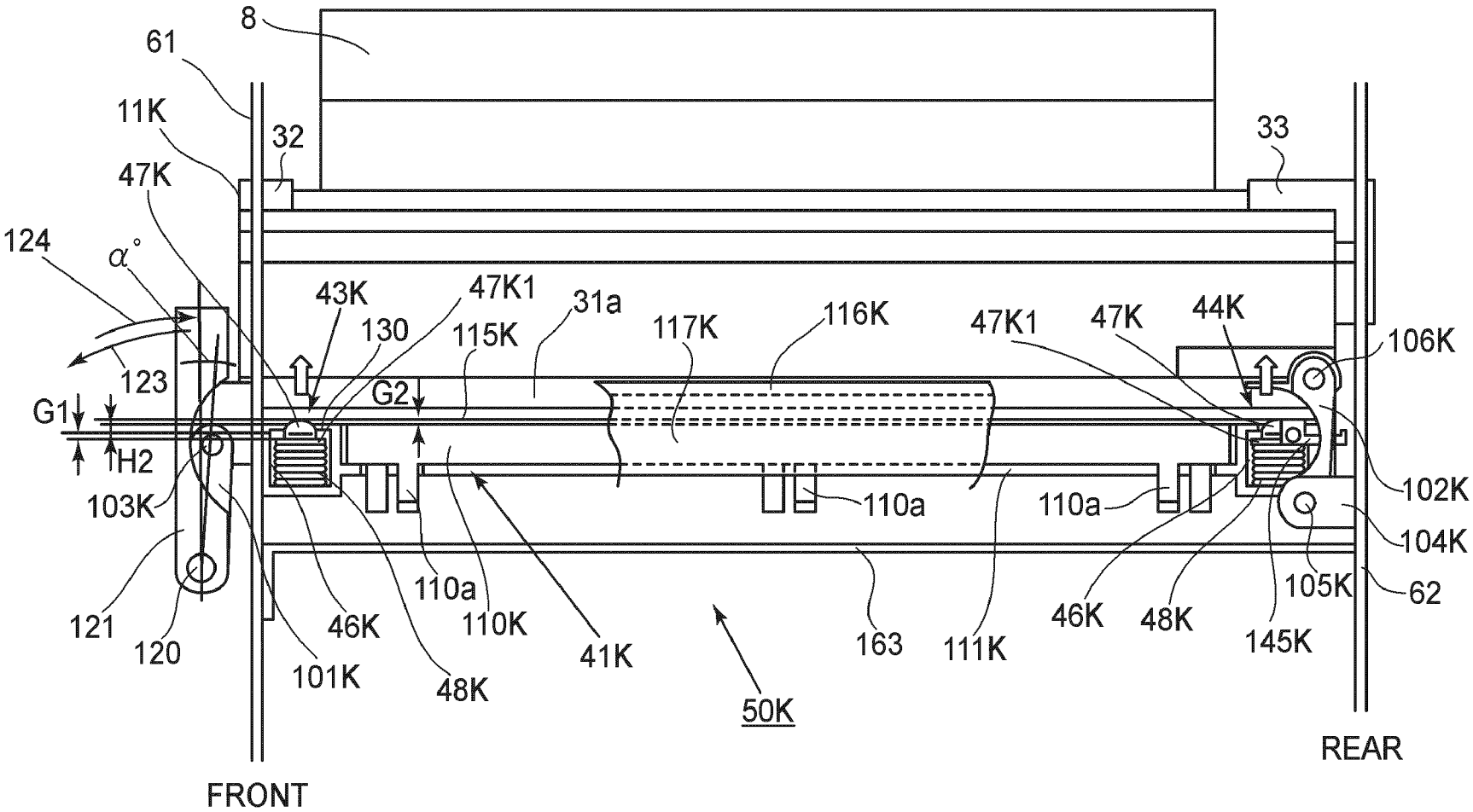
FIG. 6 is a sectional view of a tray lifting and lowering mechanism placed in a state in which a tray is moved up to a first position so that the cartridge is located at an image formable position.

As described below, as shown in FIG. 6, the tray 41K is provided with urging members 43K and 44K for holding the cartridge 11K by urging the cartridge 11K against the apparatus main assembly.

The respective trays 41Y, 41M, 41C, 41K are disposed in parallel to each other with respect to the left-right direction. Each tray 41Y, 41M, 41C, 41K is a member having a shape and a size substantially corresponding to a bottom surface shape of the cartridge 11Y, 11M, 11C, 11K. The trays 41Y, 41M, 41C, 41K are disposed, with their longitudinal directions as the front-rear direction, horizontally in parallel to each other from a left side to a right side. The respective trays 41Y, 41M, 41C, 41K are, as described later, moved together upwardly and downwardly while being synchronized by the lifting and lowering mechanism interrelated with an opening and closing operation of the openable door 2.

In this embodiment, each tray 41Y, 41M, 41C, 41K is moved upwardly in interrelation with a closing operation of the openable door 2 to hold its respective cartridge 11Y, 11M, 11C, 11K at the first position in which its respective cartridge 11Y, 11M, 11C, 11K is positioned in the apparatus main assembly 3. Further, each tray 41Y, 41M, 41C, 41K is moved downwardly in interrelation with an opening operation of the openable door 2. Thus, each tray 41Y, 41M, 41C, 41K is held at the second position in which the cartridge is detachably mountable to the apparatus main assembly 3.

In the image forming apparatus 1 of this embodiment, exchange of the cartridge 11Y, 11M, 11C, 11K is performed in a front-access exchanging manner in which the openable door 2 provided to the front surface of the image forming apparatus 1 as shown in FIG. 2 is opened as shown in FIG. 3. A reference numeral 2*a* represents a handgrip portion, for the opening and closing operation, provided to the openable door 2. When the openable door 2 is opened, an opening 61*a* provided in the front frame 61 of the main assembly frame is exposed.

This opening 61*a* is an opening through which each cartridge 11Y, 11M, 11C, 11K is caused to pass for being inserted into the apparatus main assembly 3 and detached from the inside of the apparatus main assembly 3, i.e., an opening for mounting and demounting the cartridge 11Y, 11M, 11C, 11K.

Figure 8:
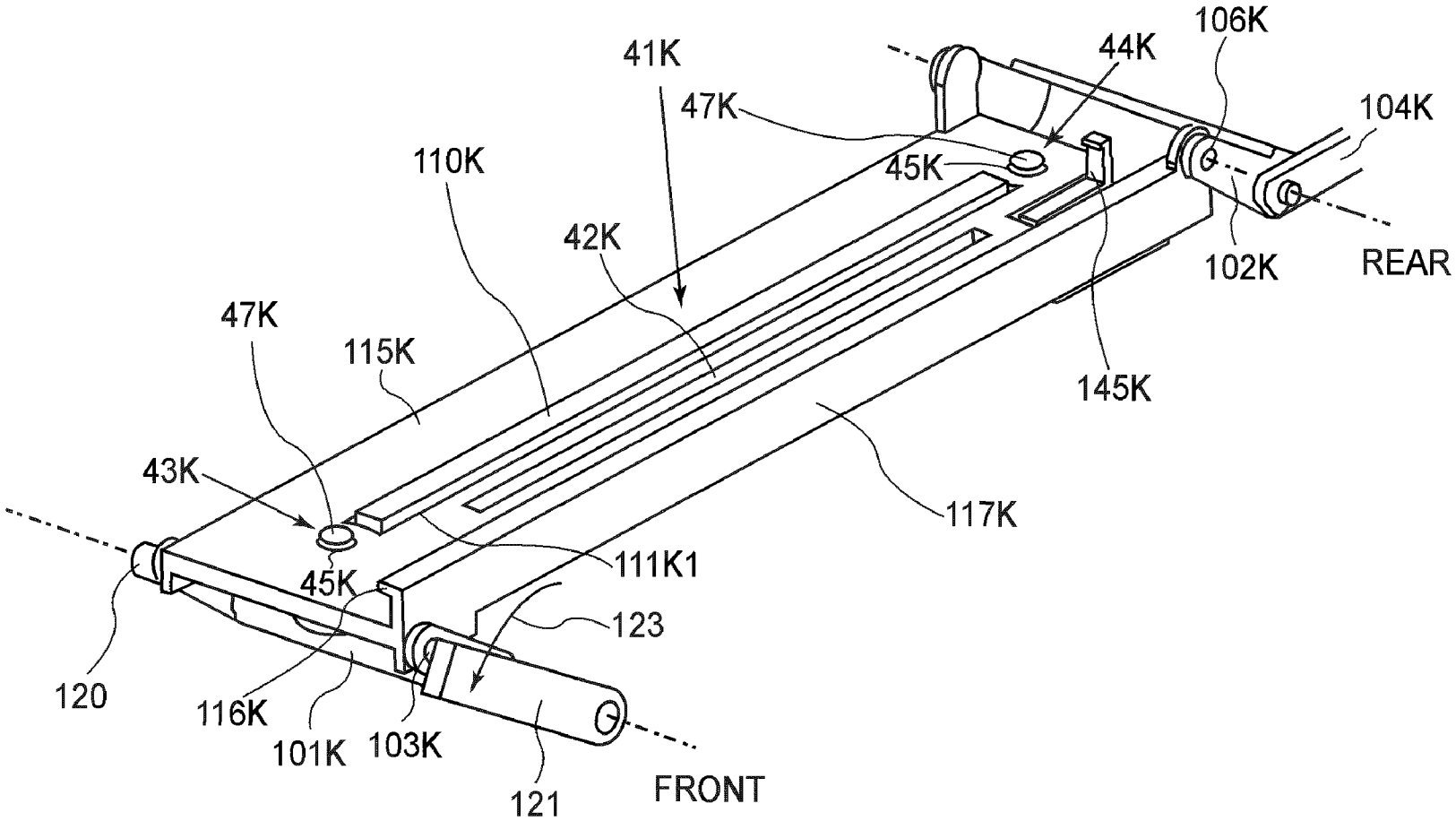
FIG. 8 is a perspective view of the lifting and lowering mechanism placed in a state in which the tray is moved down to a second position.
Figure 9:
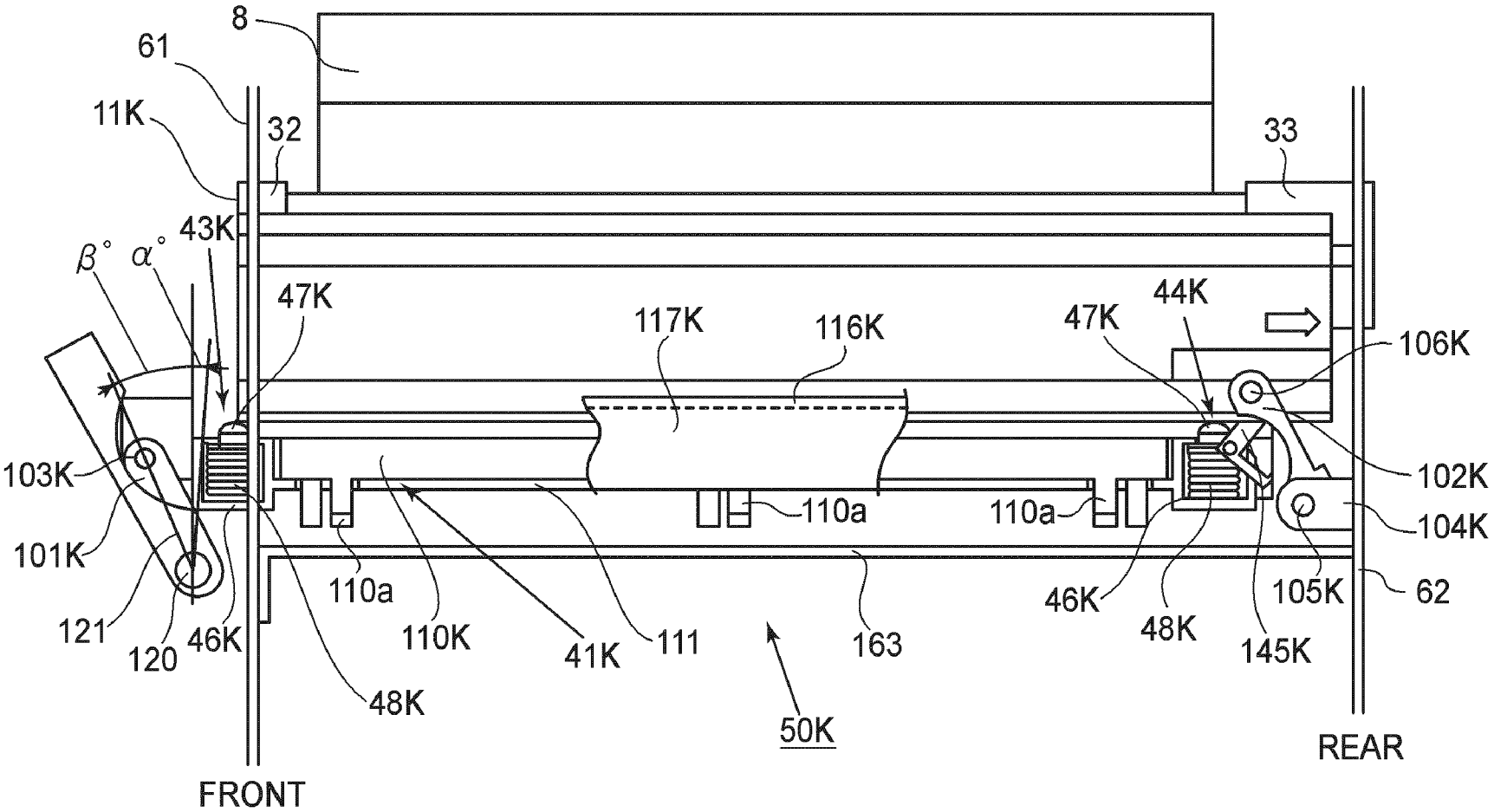
FIGS. 9 to 14 are sectional views for illustrating a cartridge exchange operation.
Figure 10:
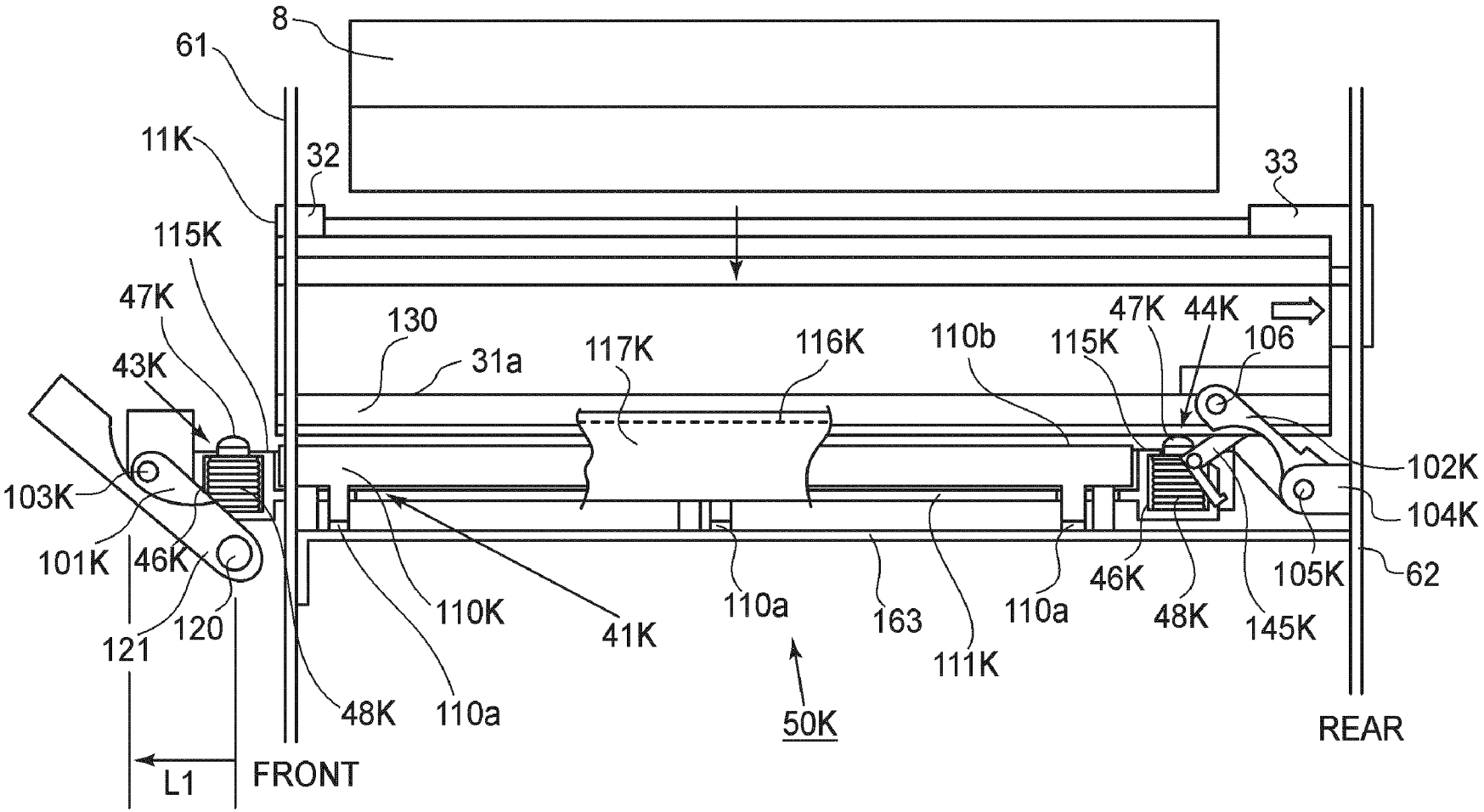

A mounting and demounting direction of each cartridge 11Y, 11M, 11C, 11K with respect to the apparatus main assembly 3 is an axial direction of the drum 12 (the longitudinal direction of the cartridge 11Y, 11M, 11C, 11K). For the insertion of the cartridge 11Y, 11M, 11C, 11K, in a state in which the openable door 2 is opened and the tray 41Y, 41M, 41C, 41K is held at the second position (FIG. 8), the cartridge 11Y, 11M, 11C, 11K is inserted from the opening 61*a* into the apparatus main assembly 3 with the driving side thereof as a leading side to place the driving side thereof on its respective tray 41Y, 41M, 41C, 41K. The cartridge 11Y, 11M, 11C, 11K is sufficiently pushed into the apparatus main assembly 3 by sliding movement thereof on its respective tray 41Y, 41M, 41C, 41K. Thus, as described later, the cartridge 11Y, 11M, 11C, 11K is urged toward a direction of the rear frame 62 by a thrust bar (thrust urging member) 145K (FIG. 8). As a result, a rear end surface portion of the cartridge 11Y, 11M, 11C, 11K abuts against the rear frame 62, so that a position of the cartridge 11Y, 11M, 11C, 11K with respect to a mounting direction is regulated (FIG. 9 and FIG. 10).

Figure 11:
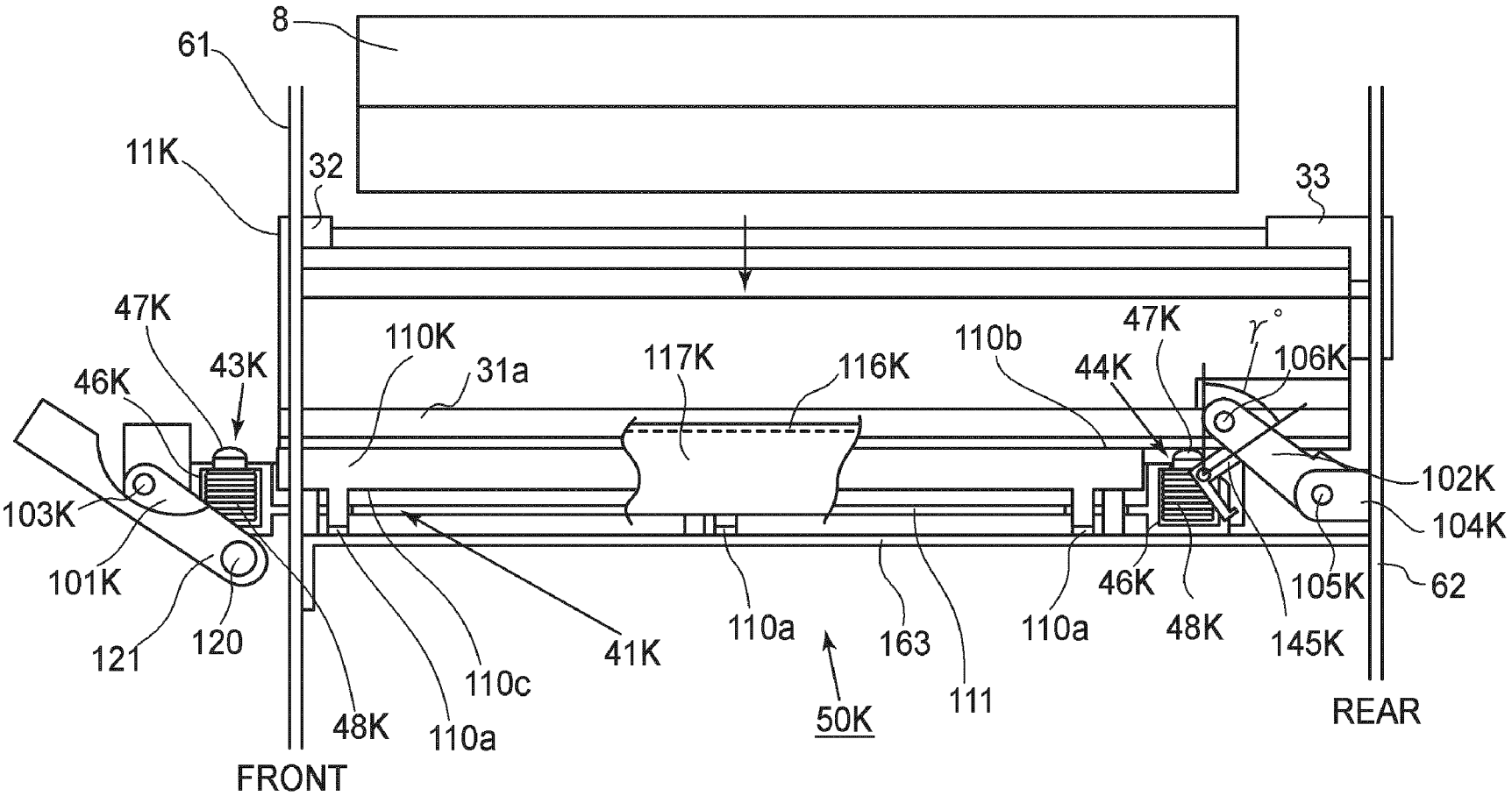
Figure 12:
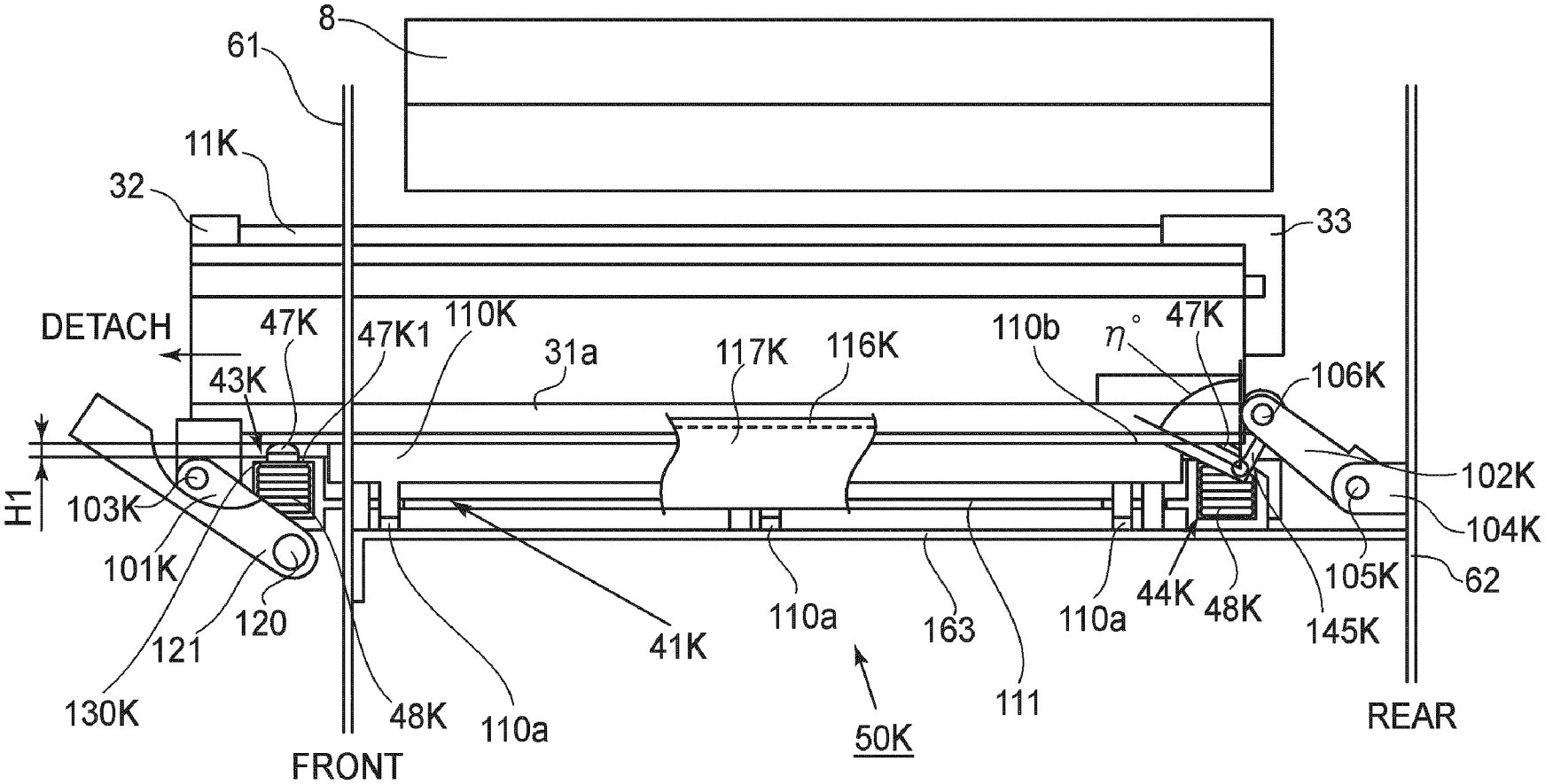

Further, detachment (removal) of the cartridge 11Y, 11M, 11C, 11K is performed, in a state in which its respective tray 41Y, 41M, 41C, 41K is held at the second position, by sliding movement of the cartridge 11Y, 11M, 11C, 11K on its respective tray 41Y, 41M, 41C, 41K in a direction opposite to the mounting direction to be pulled out (FIG. 11 and FIG. 12).

As described above, the respective trays 41Y, 41M, 41C, 41K are moved together upwardly and downwardly while being synchronized by the lifting and lowering mechanism interrelated with the opening and closing operation of the openable door 2.

Figure 5C:
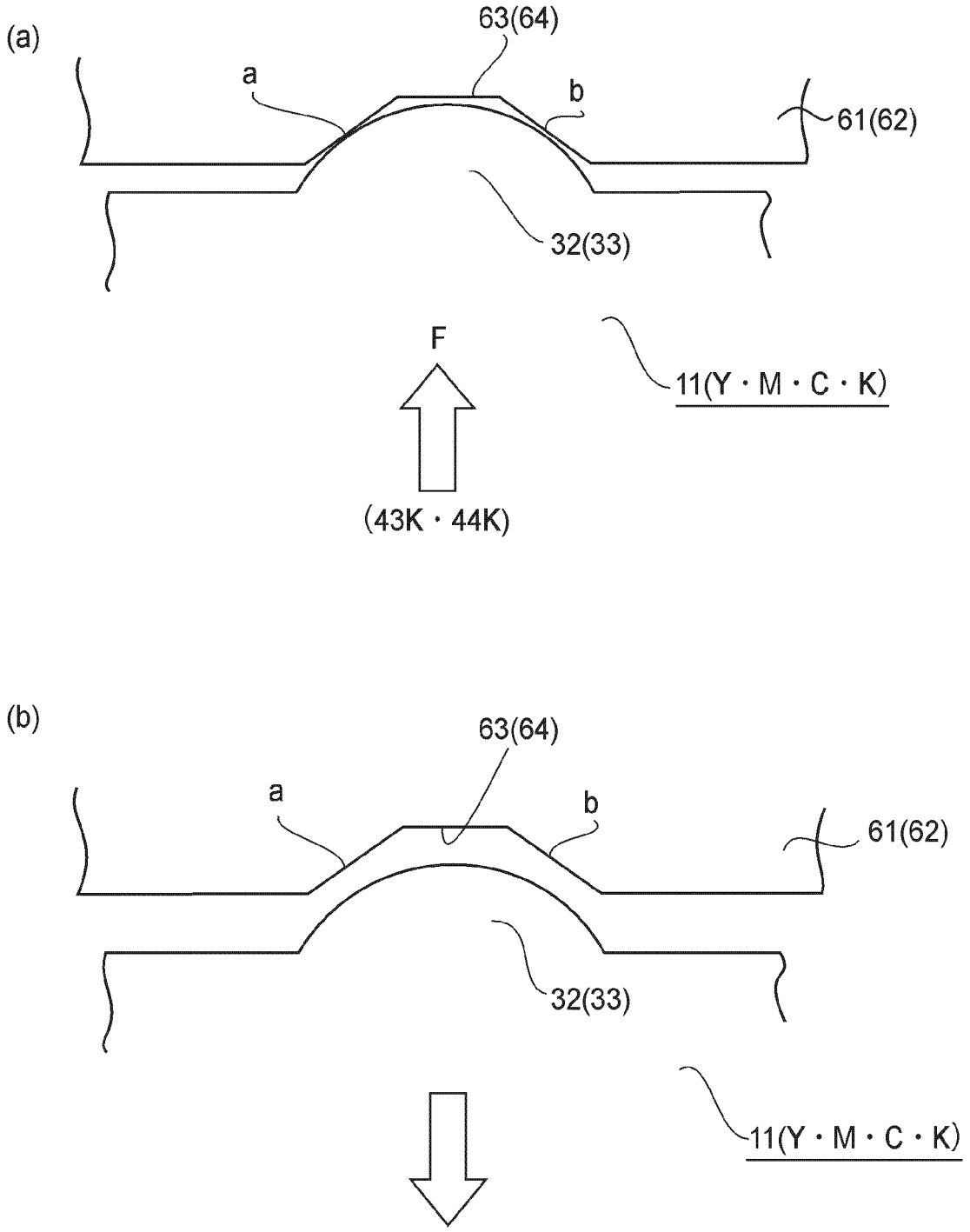
FIGS. 5C(a) and 5C(b) are schematic views for illustrating a cartridge positioning portion.

In a state in which the tray 41Y, 41M, 41C, 41K is held at the first drum (FIG. 7), upper portions of the front and rear bearing portions 32 and 33 for the cartridge 11Y, 11M, 11C, 11K abut against abutting portions 63 and 64 provided to the front and rear frames 61 and 62 of the main assembly frame. FIG. 5C(a) shows this abutting state. The abutting portions (process cartridge abutting portions) 63 and 64 as a positioning portion are a trapezoidally (cut) recessed portion. The upper portions of the bearing portions as a portion to be positioned is a convex portion having an arcuate surface. The convex portion is engaged in the recessed portion, so that these portions contact each other at two points a and b. Then, as described later, the bearing portions 32 and 33 are elastically urged (pressed) against the abutting portions 63 and 64 by an urging force F by the urging members (urging means) 43K and 44K, provided to the tray 41K, for elastically receiving and supporting the cartridge 11Y, 11M, 11C, 11K. As a result, the cartridge 11Y, 11M, 11C, 11K is positioned and fixed to the front and rear frames 61 and 62 of the main assembly frame. That is, the cartridge 11Y, 11M, 11C, 11K is placed in a state in which the cartridge 11Y, 11M, 11C, 11K is positioned in a predetermined manner with respect to the intermediary transfer belt unit 4 and the laser scanner unit 16 which are similarly positioned and fixed to the frames 61 and 62. To the intermediary transfer belt unit 4, the drum 12 is positioned and fixed at a position (state) in which the drum 12 contacts the belt 8.

Further, in a state in which the tray 41Y, 41M, 41C, 41K is held at the second position (FIG. 8), the front and rear bearing portions 32 and 33 for the cartridge 11Y, 11M, 11C, 11K are moved apart from the abutting portions 63 and 64 of the front and rear frames 61 and 62 as shown in FIG. 5C(b). As a result, the positioning fixation of the cartridge 11Y, 11M, 11C, 11K to the apparatus main assembly 3 is released, so that the cartridge 11Y, 11M, 11C, 11K is detachable (removable) from the inside of the apparatus main assembly 3.

<Tray Lifting and Lowering Mechanism>

In this embodiment, the tray 41Y, 41M, 41C, 41K is movable to the first position and the second position while supporting a bottom surface and a side surface of its respective cartridge 11Y, 11M, 11C, 11K. Further, the first position is located above the second position. In an apparatus including a plurality of cartridges 11Y, 11M, 11C, 11K as in the image forming apparatus 1 of this embodiment, a plurality of trays 41Y, 41M, 41C, 41K is provided correspondingly to the plurality of the cartridges 11Y, 11M, 11C, 11K.

The tray lifting and lowering mechanism (holding means) for lifting and lowering the first to fourth trays 41Y, 41M, 41C, 41K have the same constitution and operation and therefore a constitution and an operation of a tray lifting and lowering mechanism 50K for the fourth tray 11K will be described as a representative example.

Figure 7:
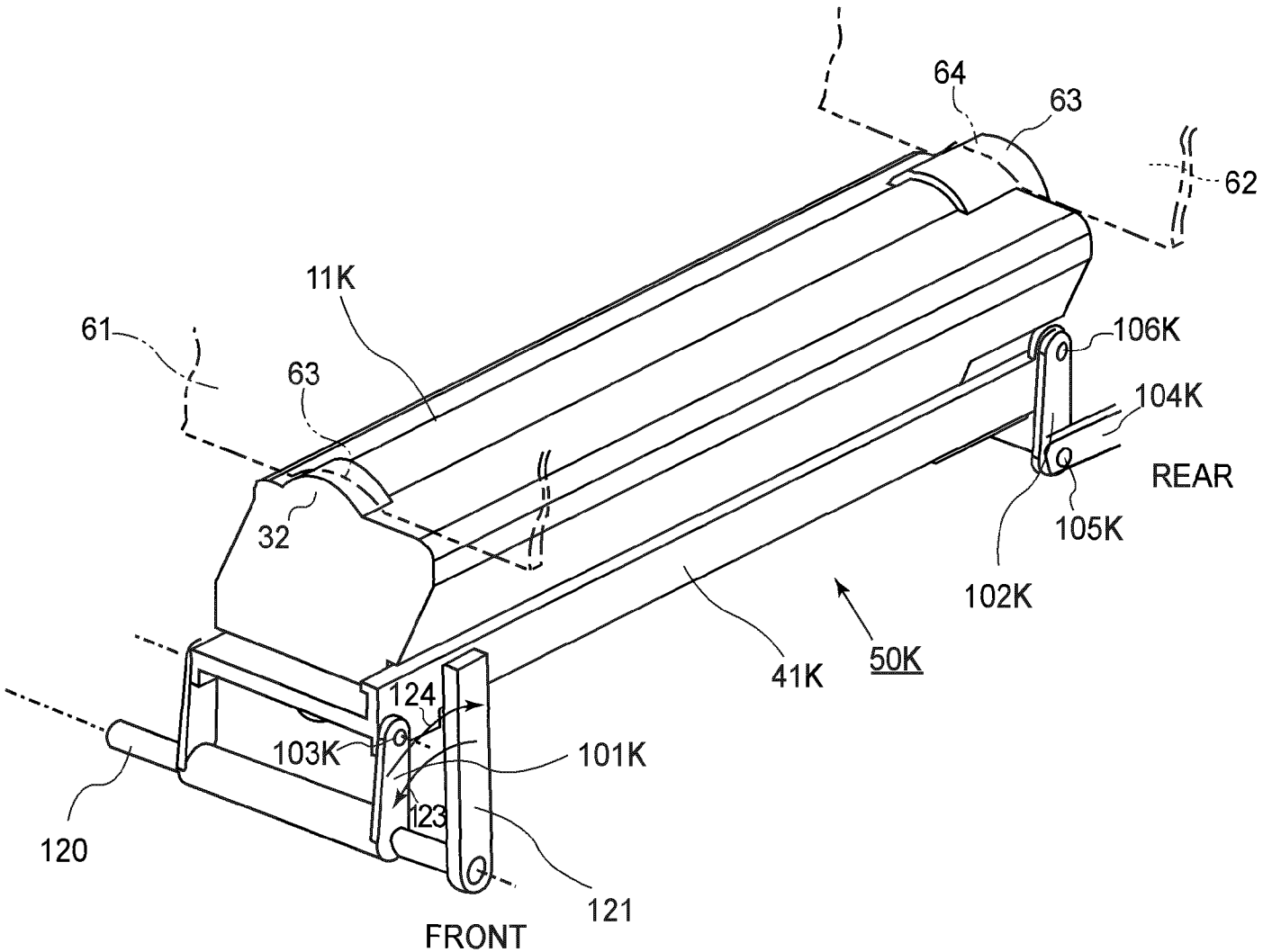
FIG. 7 is a perspective view of the cartridge and the lifting and lowering mechanism placed in the state shown in FIG. 6.

FIG. 6 and FIG. 7 are a sectional view and a perspective view of the tray lifting and lowering mechanism 50K when the tray 41K is moved up to the first position. FIG. 8 is a perspective view of the tray lifting and lowering mechanism 50K placed in a state in which the tray 41K is moved down to the second position, from which the cartridge 11K is removed.

A front end portion of the tray 41K is rotatably supported by an end portion of a front tray arm member 101K, rotatable together with a link shaft 120, through a connecting shaft 103K. Further, a rear end portion of the tray 41K is rotatably supported by an end portion of a rear tray arm member 102K, rotatably supported by a fixed supporting member 104K through a connecting shaft 105K, through a connecting shaft 106K.

The tray 41K constitutes a parallelogram link mechanism by the link shaft 120, the front tray arm member 101K, the connecting shaft 103K, the connecting shaft 105K, the rear tray arm member 102K, and the connecting shaft 106K.

The link shaft 120 extends in a direction of other trays 41C, 41M and 41Y and at an extension portion of the link shaft 120, tray arm members (101Y, 101M, 101C (not shown)) corresponding to the other trays and fixedly disposed. With respect to each of the other trays 41C, 41M and 41Y, the parallelogram link mechanism is constituted similarly as in the case of the above-described tray 41K.

To the link shaft 120, a link lever 121 is fixedly attached. By rotating the link lever 121, the link shaft 120 is rotated together with the link lever 121. Then, by the rotation of the link shaft 120, the respective trays 41Y, 41M, 41C, 41K are obliquely translated together while being synchronized by the above-described parallelogram link mechanisms.

When the link lever 121 is rotated in a direction of an arrow 124 which is a rising direction of the link lever 121, the tray 41K is moved upwardly while describing an arc. As a result, the tray 41K is moved to the first position (FIGS. 6 and 7).

On the other hand, when the link lever 121 is rotated in a direction of an arrow 123 which is a falling direction toward the front side, the tray 41K is moved downwardly while describing an arc. As a result, the tray 41K is moved to the second position (FIGS. 8 and 11).

The link lever 121 is rotationally operated in interrelation with the opening and closing operation of the openable door 2 of the image forming apparatus. An interrelating mechanism of the openable door 2 and the link lever 121 are omitted from the drawings.

That is, the link lever 121 is rotated in the direction of the arrow 124 in interrelation with the closing rotation of the openable door 2 with respect to the apparatus main assembly 3. By this rotation, the tray 41K is moved upwardly to reach the first position. Then, the openable door 2 is completely closed, the link lever 121 contacts a receiving portion (not shown) of the front frame 61 and is rotation-stopped in a state in which the tray 41K is placed in the first position.

Further, the link lever 121 is rotated in the direction of the arrow 123 in interrelation with the opening rotation of the openable door 2 with respect to the apparatus main assembly 3. By this rotation, the tray 41K is moved downwardly to reach the second position.

A reference numeral 42K (FIG. 8) represents a slit opening as a laser light incident portion formed, at a substantially central portion with respect to a widthwise direction of the tray surface, along a longitudinal direction of the tray surface.

In a state in which, a corresponding cartridge 11Y, 11M, 11C, 11K mounted on each of the trays 41Y, 41M, 41C, 41K is moved, the bottom surface side slit opening 38 (FIG. 5A) of the cartridge frame 31 is located correspondingly to the slit opening 42 on the tray 41Y, 41M, 41C, 41K side. Then, the laser light L emitted upwardly from the laser scanner unit 16 located below the tray 41Y, 41M, 41C, 41K enters the inside of the cartridge 11Y, 11M, 11C, 11K through the slit openings 42 and 38.

Further, as shown in FIG. 6, the urging members (urging means) 43K and 44K for elastically receiving and supporting the cartridge 11K and disposed on the front side and the rear side, respectively, of an upper tray surface 115K. These urging members 43K and 44K urge the cartridge 11K, at the first position of the tray 41K, toward predetermined positions (abutting portions 63 and 64) of the apparatus main assembly, thus holding the cartridge 11K at the first position of the tray 41K.

These front and rear urging members 43K and 44K are accommodated in associated ones of urging member accommodating portions 46K formed on the tray 41K. Further, each of the urging members 43K and 44K is constituted by a coil spring 48K and an urging portion 47K. An upper portion of the urging portion 47K projects from a hole (second hole) 45K provided in the upper surface 115K of the tray 41K. When the tray 41K is located at the second position (FIGS. 12 and 13), a flange portion 47K1 of the urging portion 47K abuts against an abutting portion 130K which is a surface opposite from the upper surface 115K, so that the urging portion 47K projects from the upper surface 115K by H1. When the tray 41K is located at the first position (FIG. 6), between the flange portion 47K1 and an abutting portion 130 which is a surface opposite from the upper surface 115K, a spacing G1 is created in a predetermined amount. The urging portion 47K is placed in a state in which it projects from the upper surface 115K by H2. That is, the coil spring 48K is compressed so as to press the cartridge 11K against the abutting portions 63 and 64.

Further, when the tray 41K is located at the first position, the front and rear tray arm members 101K and 102K are, as shown in FIG. 6, held in a state in which a position at a rotation center of the tray 41K is inclined about a rotation center of the link shaft 120 by $\alpha$ degrees from a vertical direction toward the frame side. By doing so, at the first position, a force for rotating the tray 41K toward the direction of the arrow 124 is continuously exerted on the tray 41K. By employing a constitution in which the link lever 121 is caused to contact a (force-)receiving portion (not shown) of the front frame 61 to be rotation-stopped and positioned, the link lever 121 is placed in a state in which a force is always exerted on the link lever 121 toward an abutting direction against the front frame 61. For this reason, it is possible to prevent the tray 41K to move to the second position (FIG. 8) due to variations, vibrations, dropping, or the like of parts, so that a holding state of the tray 41K at the first position is stabilized.

Further, as shown in FIG. 6, to a holding portion 111K formed on the tray 41K, a guiding member (assisting rail) 110K for guiding the cartridge 11K during insertion and detachment of the cartridge 11K is slidably (movably) attached in a vertical direction. Further, as shown in FIG. 8, in the upper surface 115K of the tray 41K, a first opening 111K1 for permitting projection of the guiding member 110K from the upper surface 115K is provided. The opening 111K1 is formed, along the longitudinal direction of the tray 41K, between the front and rear urging members 43K and 44K. The guiding member 110K has a length corresponding to a length of the opening 111K. The guiding member 110K is, as shown in FIG. 6, in a state in which the tray 41K is moved to the first position, held in a recessed portion 111 with a spacing G2 so as not to contact the cartridge 11K. That is, the guiding member 110K is constituted so as to be placed in a state in which the guiding member 110K supports the cartridge 11K (guide position) when the tray 41K is located at the second position and is placed in a state in which the guiding member 110K is moved apart from the cartridge 11K (separation position) when the tray 41K is located at the first position. The guiding member 110K has, at the separation position, a guiding surface 110*b* which has the same level as the upper surface of the tray 41K or is moved away from the upper surface 115K to a recessed position. A detailed constitution will be described later.

Figure 18:
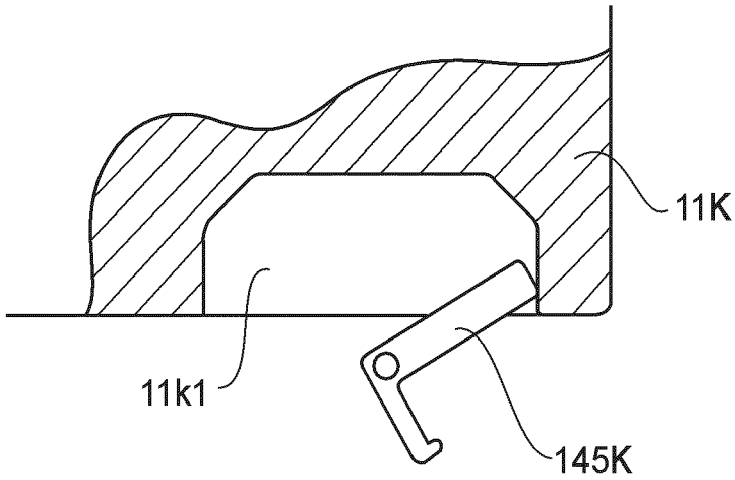
FIG. 18 is a partly sectional view of the cartridge in a First Embodiment.

As shown in FIG. 8, a reference numeral 145K represents a thrust lever as a thrust urging member and is, as shown in FIG. 9, rotatably held by the tray 41K. The cartridge 11K on the tray 41K is urged toward the rear frame 62 by the thrust lever 145K urged by a thrust spring 146K, so that a rear end surface portion of the cartridge 11K is always abutted against the inner surface of the rear frame 62. At this time, the thrust lever 145K is, as shown in FIG. 18, urged by engaging with an engaging hole 11K1 provided in the cartridge 11K. As a result, the position of the cartridge 11K is constituted so as to be regulated with respect to a mounting direction of the cartridge 11K to the apparatus main assembly 3, so that the cartridge 11K is moved to the first position and the second position while being urged toward the rear frame 62.

Further, to the first and second electrical contact portions 36 and 37 on the driving side of the cartridge 11K, first and second main assembly electrical contact portions (not shown) on the apparatus main assembly side are electrically connected. In this case, an abutting force of the thrust lever 145K is designed so that it is sufficiently larger than a contact pressure of the electrical contacts in order to ensure abutment of the cartridge 11K against the rear frame 11K.

Further, to a side surface 117K of the tray 41K, as shown in FIG. 8, an engaging portion 116K as a regulating portion is provided. The engaging portion 116K engages with a groove 31*a* provided to the cartridge 11K when the tray 41K is located at the second position and the cartridge 11K is mounted. The engaging portion 116K regulates upward movement of the cartridge 11K. That is, the engaging portion 116K prevent damage of the belt 8 and the drum (photosensitive member) 12 due to contact between the belt 8 and the drum 12 when the cartridge 11K is mounted and demounted.

Hereinbelow, operations of respective portions during exchange of the process cartridge 11Y, 11M, 11C, 11K will be described.

(i) FIG. 6 shows a state in which the openable door 2 of the image forming apparatus is closed. In this state, the link lever 121 is rotated in the direction of the arrow 124 in interrelation with the closing of the openable door 2. By this rotation, the tray 41K is moved upwardly, so that the cartridge 11K is moved to the first position. The link lever contacts the receiving portion of the front frame 61, thus being rotation-stopped. A rear end surface portion of the cartridge 11K abuts against and is stepped by the inner surface of the rear frame, so that a position of the cartridge 11K is regulated with respect to the mounting direction toward the apparatus main assembly 3. The front and rear bearing portions 32 and 33 for the cartridge 11K abut against the abutting portions 63 and 64 by an urging force F of the urging members 43K and 44K, so that the cartridge 11K is positioned and fixed (FIG. 5C(a)). To the drum driving coupling 34 and the developing roller driving coupling 35 of the cartridge 11K, associated driving units (not shown) on the apparatus main assembly side are connected.

Further, to the first and second electrical contact portions 36 and 37 of the cartridge 11K, the first and second main assembly electrical contact portions (not shown) on the apparatus main assembly 3 side are electrically connected. That is, the image forming apparatus is placed in a state in which the image forming apparatus is capable of performing an image forming operation.

(ii) In order to, e.g., exchange new and old cartridges 11, when the openable door 2 of the image forming apparatus is opened from the above-described state shown in FIG. 6, the link lever 121 is rotated in the direction of the arrow 123 in interrelation with the opening rotation of the openable door 2.

By this rotation, along rotation trails of the tray arm members 101K and 102K, as shown in FIG. 9, the tray 41K is moved toward the front side so as to describe an arc. During a period from after the tray arm members 101K and 102K are rotated by an angle of a degrees and the tray arm members 101K and 102K are rotated by an angle of β degrees until the urging portions 47K contact the abutting portions 130, the cartridge 11K is continuously urged against the frames 61 and 62 by the urging portions 47K. For that reason, the cartridge 11K is at rest in a state in which the cartridge 11K is positioned by the abutting portions 63 and 64. Further, from the drum driving coupling 34 and the developing roller driving coupling 35 of the cartridge 11K, the driving units (not shown) on the apparatus main assembly side are separated and moved. Further, from the first and second electrical contact portions 36 and 37 of the cartridge 11K, the first and second main assembly electrical contact portions on the apparatus main assembly side are separated and moved.

(iii) Further, when the link lever 121 is rotated, the cartridge 11K is started to be lowered in a state in which the cartridge 11K is placed on the urging portions 47K. Also at this time, the cartridge 11K is urged so as to contact the rear frame 62, so that the tray 41K is lowered while describing the arc but the cartridge 11K is lowered while contacting the rear frame 62.

(iv) When the cartridge 11K is continuously lowered, as shown in FIG. 10, guide supporting portions 110*a* of the guiding member 110 contact a connecting frame 163. By this contact, even when the tray 41K is lowered, the guiding member 110 is not lowered, so that a guide surface 110*b* is relatively higher than the upper tray surface 115K.

(v) As shown in FIG. 11, when the openable door 2 is sufficiently opened to stop the rotation of the link lever 121 at a predetermined angle, the tray 41K is at rest in the second position state. In this case, the tray 41K may be held at the second position by any of the tray arm members 101K and 102K, the frames 61 and 62, and the connecting frame 163.

When the tray 41K is located at the second position, the guiding member 110K contacts the connecting frame 163 and is held by the connecting frame 163 and projects from the opening 111K provided in the upper tray surface 115K. In this embodiment, a projection amount of the guiding member 110K from the upper tray surface 115K is equal to the projection amount H1 of the urging members 43K and 44K from the upper tray surface 115K at the second position. That is, the guide surface 110*b* and the urging portions 47K are located at the same level (height) from the upper tray surface 115K.

Further, the cartridge 11K is urged so as to contact the rear frame 62 by the thrust lever 145K. In this case, the thrust lever 145K is placed in a state in which it moves y degrees from the position in which it urges the cartridge 11K toward the rear frame 62 at the first position of the tray 41K.

The tray 41K is placed in a state in which it moves toward the front side by a distance L1 with respect to the first position (FIG. 6) of the tray 41K. The cartridge 11K is supported in a state in which it is placed on the rear urging portion 47K and the guiding member 110K. That is, the guiding member 110K is supported on the connecting frame 163 on the apparatus main assembly side at the second position of the tray 41K, thus being placed in a state in which the guiding member 110K supports the cartridge 11K. At the second position of the tray 41K, the guiding member 110K and the urging members 43K and 44K support the cartridge 11K.

(vi) When the user intends to detach the cartridge 11K for exchanging the cartridge 11K, as shown in FIG. 12, the thrust lever 145K is pushed back by the cartridge 11K. Then, when the thrust lever 145K is moved back by a predetermined angle of η degrees, a thrust spring (not shown) goes over a rotation center of the thrust lever 145K, thus operating the thrust lever 145K so that the thrust lever 145K is rotated in the counterclockwise direction.

When the cartridge 11K is detached, the cartridge 11K can be smoothly detached without being caught on the front urging portion 47K since the front urging portion 47K and the guide surface 110*b* of the guiding member 110K have the same height.

Also at the time of inserting a new cartridge 11K, the front urging portion 47K and the guide surface 110*b* of the guiding member 110K have the same height, so that the cartridge 11K is not caught on the front urging portion 47K. Further, the rear urging portion 47K and the guide surface 110*b* of the guiding member 110K have the same height, so that the cartridge 11K is not caught on the rear urging portion 47K. As a result, it is possible to smoothly insert the cartridge 11K into the apparatus main assembly.

In this embodiment, the constitution in which the urging portions 47K and the guide surface 110*b* of the guiding member have the same height is described. However, if there is no trouble during the mounting and demounting of the cartridge 11K, there is no problem even when a stepped portion is created between the urging portions 47K and the guide surface 110*b*. That is, in the present invention, the heights of the urging portions 47K and the guide surface 110*b* of the guiding member 110K are not necessarily equal to each other.

However, in the case of no guiding member 110K, when the cartridge 11K is mounted or demounted, the cartridge 11K is caught on the front or rear urging portion 47K. For this reason, a superfluous force for riding the cartridge 11K on the urging portions 47K is required, thus resulting in a poor mounting operability. More specifically, the new cartridge 11K is 2-3 kg in weight, thus being considerably weighty and being liable to be caught on the urging portions 47K, so that an operating force for riding the cartridge 11K on (over) the urging portion 47K is very large. And it is hard for the user to see whether the cartridge 11K is caught on the rear urging portion 47K i.

Figure 13:
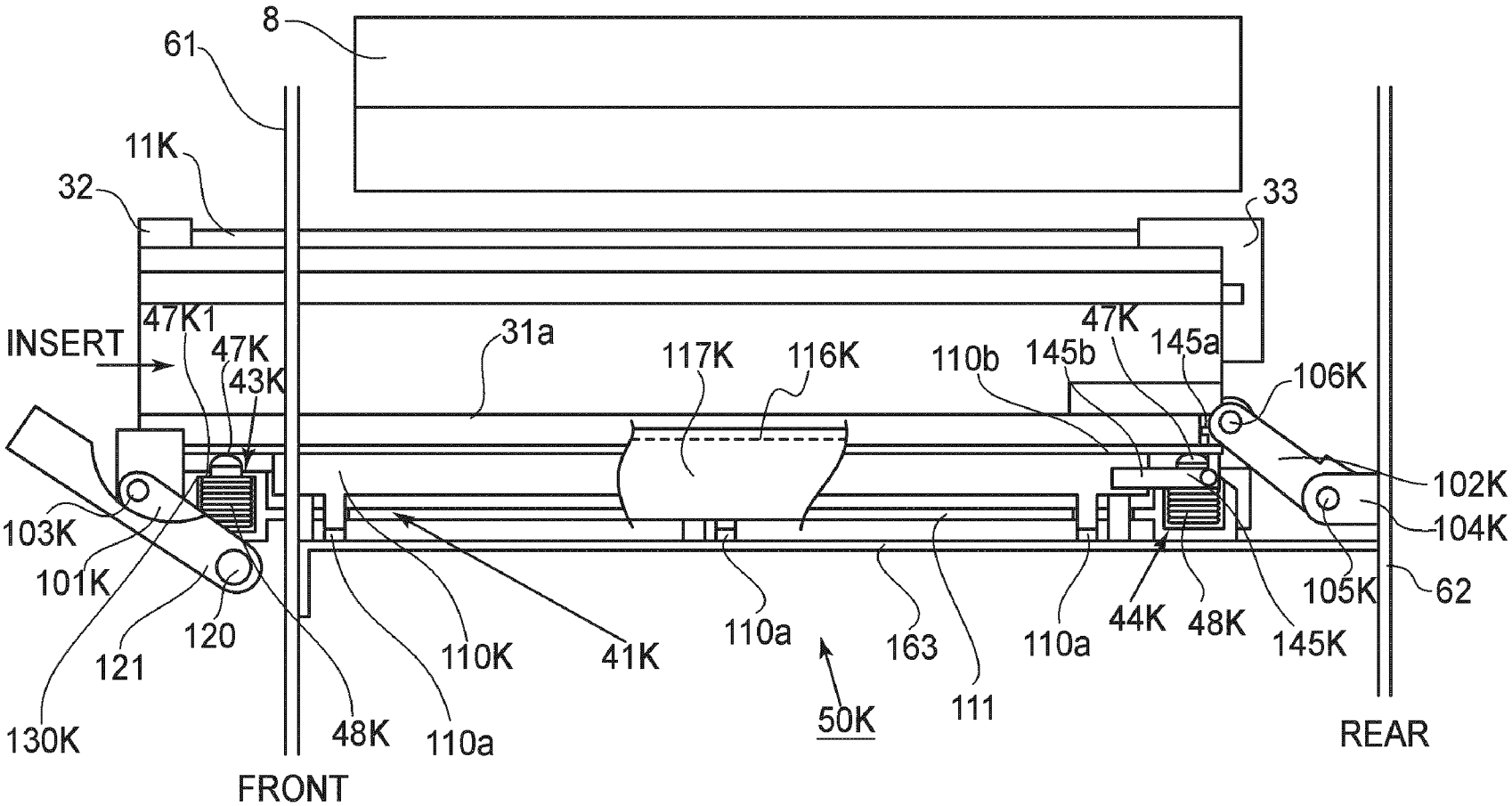
Figure 14:
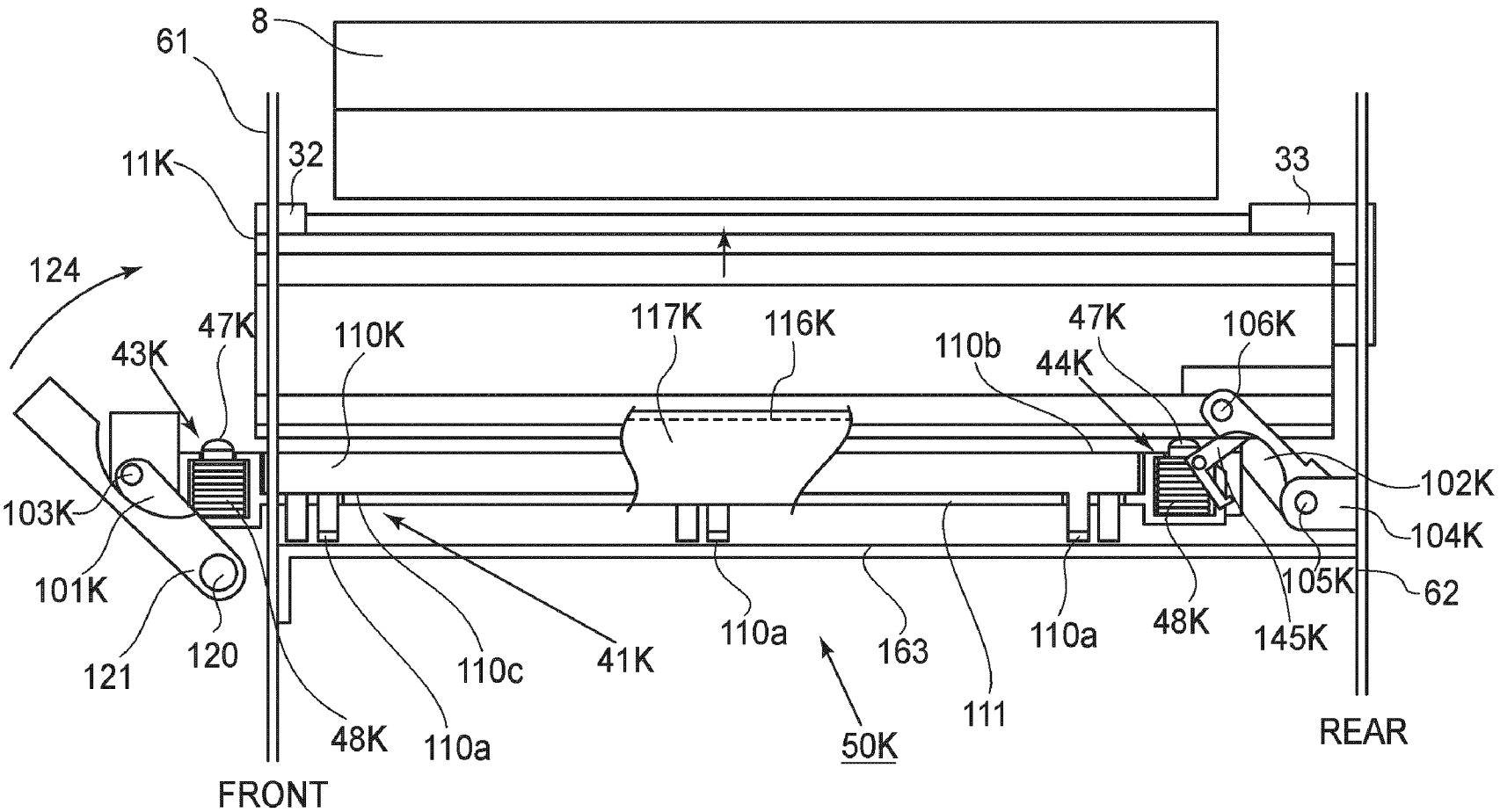

(vii) When the cartridge 11K is inserted into the apparatus main assembly, as shown in FIG. 13, the cartridge 11K abuts against a projection 145*a* of the thrust lever 145K. From this state, when the cartridge 11K is further pushed, the thrust lever is rotated by the cartridge 11K. Then, when the thrust lever is rotated by the predetermined angle of η degrees, the thrust lever 145K is rotated by the action of the thrust spring 146K. Then, the projection 145K pushes out the cartridge 11K toward the rear frame 62, so that as shown in FIG. 14, the rear end surface portion of the cartridge 11K is abutted against the inner surface of the rear frame 62.

The rotation of the thrust lever 145K by the predetermined angle of η degrees is performed by the user, so that a fluctuation in operating force is required to be minimized. According to design by the present inventors, it is confirmed that, e.g., when a value of the fluctuation is about 200-300 gf, the thrust lever 145K is insertable with no problem.

By the action of the thrust lever 145K, the cartridge 11K is abutted against the rear frame 62, so that the user can feel that the cartridge 11K is inserted and set in the apparatus main assembly 3 by both the sound that is generated by this action and by the user's ability to see that the cartridge 11*k* is so inserted.

Further, in this embodiment, a position in which the cartridge 11K is set in a half-finished state is less misidentified as a proper set position of the cartridge 11K, so that human errors in the cartridge-exchanging operation can be significantly decreased.

Further, as described above, the constitution in which the groove 31*a* provided to the cartridge 11K is engaged with the engaging portion 116K provided to the tray 41K when the cartridge 11K is detached or inserted is employed in this embodiment. As a result, an occurrence of contact damage of the belt 8 or the drum 12 due to the contact of the cartridge 11K with the belt 8 by the operation of the user is prevented.

(viii) From the state shown in FIG. 14, the openable door 2 is rotated for closing. In interrelation with the closing rotation of the openable door 2, the link lever 121 is rotated in the direction of an arrow 124, so that the tray 41K is moved upwardly so as to describe the arc. As a result, as shown in FIG. 14, the tray 41K contacts a receiving surface 110*c* of the guiding member 110K, so that the guiding member 110K is also moved upwardly together with the tray 41K. Thus, the guide supporting portion 110*a* is separated from the connecting frame 163.

Then, the front and rear bearing portions (portions of the positioned) 32 and 33 for the cartridge 11K contact the abutting portions (positioning portions) 63 and 64 of the front and rear frames 61 and 62, respectively. Further, when the front and rear urging portions 47K are pushed in for urging the cartridge 11K, the guiding member 110K is spaced apart from the cartridge 11K. That is, at the first position of the tray 41K, the guiding member 110K is placed in a state in which the guiding member 110K does not support the cartridge 11K. For that reason, the guiding member 110K does not obstruct the cartridge 11K without interfering with the cartridge 11K even when the cartridge 11K relatively approaches the tray 41K while compressing the coil springs 48K. The supporting portions 110*a* of the guiding member 110K are moved apart from the connecting frame 163 by the movement of the tray 41K to the first position. That is, the guiding member 110K is not subjected to a push-up force, so that the guiding member 110K is dropped on the holding portion 111K by its own weight and a held on the holding portion 111K.

The front and rear urging portions 47K are gradually pushed in while sliding toward the rear side of the accommodating portion 46K in synchronism with the tray 41K moving upwardly while describing the arc when the urging portions 47K are pushed into the cartridge 11K while compressing the coil springs 48K. The front rear urging portions 47K are pushed in while compressing the coil springs 48K, so that a load exerted on the tray 41K leads to a change in operation force of the user. However, the change is gradually effected, so that an effect of suppressing the fluctuation (change) in operating force is achieved.

(ix) From the above state, the openable door 2 is completely closed, so that the tray 41K is held at the first position as shown in FIG. 6. Further, to the drum driving coupling 34 and the developing roller coupling 35 for the cartridge 11K, the driving units (not shown) on the apparatus main assembly side are connected for operation. Further, to the first and second electrical connecting portions 36 and 37 of the cartridge 11K, the first and second main assembly electrical contact portions on the apparatus main assembly side are connected for operation.

The cartridge 11K mounted on the tray 41K is moved to the first position and the second position while being urged toward the rear frame 62 of the main assembly frame by the thrust urging member 145K provided to the tray 41K.

As described above, for convenience, the fourth cartridge 11K and the tray lifting and lowering mechanism 50K therefor are described as the representative example but other cartridges 11Y, 11M and 11C and tray lifting and lowering mechanisms (50Y, 50M and 50C) therefor are also similarly applicable to this embodiment.

The above description shows that it is possible to perform smooth exchange of the cartridge 11K by interrelating the opening and closing operation of the openable door 2 with the demounting and mounting operation of the cartridge 11K when the user exchanges the cartridge 11K.

Particularly, when the cartridge 11K is detached or inserted at the second position of the tray 41K, the heights of the guiding member 110K and the urging portions 47K are equal to each other, so that the mounting operability of the cartridge 11K is improved.

Further, at the first position of the tray 41Y, 41M, 41C, 41K, the tray 41Y, 41M, 41C, 41K is spaced apart from its respective cartridge 11Y, 11M, 11C, 11K with the predetermined spacing G2, so that it is possible to ensure a maximum volume of the cartridge 11Y, 11M, 11C, 11K without applying a limitation on shape of the cartridge 11Y, 11M, 11C, 11K.

The image forming apparatus of this embodiment is constituted as shown in FIG. 1 for downsizing. That is, the first to fourth cartridges are arranged in a partly overlapping state in which adjacent cartridges 11Y, 11M, 11C, 11K partly overlap with each other while decreasing an interval (pitch) Pdrm between associated (adjacent) drums of the adjacent cartridges 11Y, 11M, 11C, 11K.

In the image forming apparatus 1, in order to compatibly realize the downsizing and reduction in time required for forming the toner images on the intermediary transfer belt 8 (high productivity), it is desirable that the interval Pdrm between the adjacent drums of the respective cartridges 11Y, 11M, 11C, 11K is decreased as small as possible. However, each cartridge 11Y, 11M, 11C, 11K is required to include the developing means and the charging means on an upstream side and include the cleaning means on a downstream side, with respect to the drum rotation direction on the basis of the primary transfer portion T1. For this reason, in the cartridge 11Y, 11M, 11C, 11K, a predetermined arrangement space is required on a left side and a right side with respect to the drum. In order to decrease the interval Pdrm while the left and right arrangement space is ensured, in this embodiment, the adjacent process cartridges 11Y, 11M, 11C, 11K and arranged in the partly overlapping state in which the adjacent cartridges 11Y, 11M, 11C, 11K partly overlap with each other as described above.

In this embodiment, the positioning of the cartridge 11Y, 11M, 11C, 11K with respect to the apparatus main assembly 3 is performed in such an abutting manner that the (shaft) bearing portions 32 and 33 on the cartridge 11Y, 11M, 11C, 11K side are brought into contact with the front and rear abutting portions 63 and 64 as the position portion on the apparatus main assembly side. This positioning of the cartridge 11Y, 11M, 11C, 11K by the abutment is, compared with positioning by engagement using a hole, capable of realizing high-accuracy positioning with less play of the cartridges 11Y, 11M, 11C and 11K with respect to the frames 61 and 62 on the apparatus main assembly 3 side.

A relative positional deviation of each cartridge 11Y, 11M, 11C, 11K directly leads to deviation of an image to be primary-transferred, thus largely affecting a color image quality. For this reason, the positioning by the abutment with less play is very effective means for improving the color image quality.

Further, as shown in FIG. 5C(a), the positioning is performed by the bearing portions 32 and 33 as the portions to be positioned, the two points a and b on the abutting surface of each of the abutting portions 63 and 64 as the positioning portions, and the urging force F by the urging members 43 and 44. For this reason, by moving the tray 41Y, 41M, 41C, 41K provided with the urging members 43 and 44 away from the abutting portions 63 and 64, its respective cartridge 11Y, 11M, 11C, 11K can be separated from the positioning portions. As in this embodiment, the urging members 43 and 44 are disposed below the cartridge 11Y, 11M, 11C, 11K, so that it is possible to ensure the opening 61*a* of the apparatus main assembly in a large space when the cartridge 11Y, 11M, 11C, 11K is exchanged and it is possible to dispose the cartridge 11Y, 11M, 11C, 11K with no obstructing material during the insertion and detachment of the cartridge 11Y, 11M, 11C, 11K and with excellent usability.

In this embodiment, a description has been provided by employing the constitution of the partly overlapping arrangement in which the adjacent cartridges 11Y, 11M, 11C, 11K partly overlap with each other but the case where the cartridges 11Y, 11M, 11C, 11K do not overlap each other is also applicable.

As described above, the tray 41Y, 41M, 41C, 41K provided with the urging members 43 and 44 for urging an associated cartridge 11Y, 11M, 11C, 11K is attached to the main assembly frames 61 and 62 so that the tray 41Y, 41M, 41C, 41K is disposed substantially in parallel to the belt 8 and is movable upwardly and downwardly in the apparatus main assembly 3. Further, the tray 41Y, 41M, 41C, 41K is capable of taking the first position in which each respective cartridge 11Y, 11M, 11C, 11K is held by abutting against the abutting portions 63 and 64 of the frames 61 and 62 and the second position in which the tray 41Y, 41M, 41C, 41K is separated from the abutting portions 63 and 64. At the second position, the urging members 43 and 44 provided to the tray 41Y, 41M, 41C, 41K are held by the tray 41Y, 41M, 41C, 41K in a state in which the urging members 43 and 44 project from a surface of the tray 41Y, 41M, 41C, 41K opposing its respective cartridge 11Y, 11M, 11C, 11K by the predetermined amount, thus contacting and supporting the respective cartridge 11Y, 11M, 11C, 11K. The guiding member 110 which is held movably relative to and independently of the tray 41Y, 41M, 41C, 41K is spaced apart from its respective cartridge 11Y, 11M, 11C, 11K with the predetermined spacing at the first position. At the second position, the contact surfaces between the urging members 43 and 44 and the cartridge 11Y, 11M, 11C, 11K and at least a part of the surface of the guiding member 110 have the same height. As a result, when the user detaches or inserts the cartridge 11Y, 11M, 11C, 11K, it is possible to prevent the fluctuation in operating force due to the catching of the cartridge 11Y, 11M, 11C, 11K on the urging members 43 and 44 or the riding of the cartridge 11Y, 11M, 11C, 11K on projections of the urging members 43 and 44. For that reason, it is possible to provide the image forming apparatus 1 with a good operability, saved space, and low cost. That is, by the presence of the guiding member 110, when the cartridge 11Y, 11M, 11C, 11K is inserted into the apparatus main assembly 3, different from the conventional image forming apparatus, there is no need to guide the cartridge 11Y, 11M, 11C, 11K by somewhat raising the cartridge 11Y, 11M, 11C, 11K upwardly so that the cartridge 11Y, 11M, 11C, 11K does not contact the urging members 43 and 44. Correspondingly, it is possible to reduce the height of the image forming apparatus 1 and it is also possible to improve the mounting operability.

In this embodiment, the constitution in which the plurality of cartridges 11Y, 11M, 11C, 11K is used in the image forming apparatus is described but the present invention is also applicable to an image forming apparatus using a single cartridge 11Y, 11M, 11C, 11K.

Second Embodiment

A Second Embodiment will be described with reference to the drawings.

Figure 15:
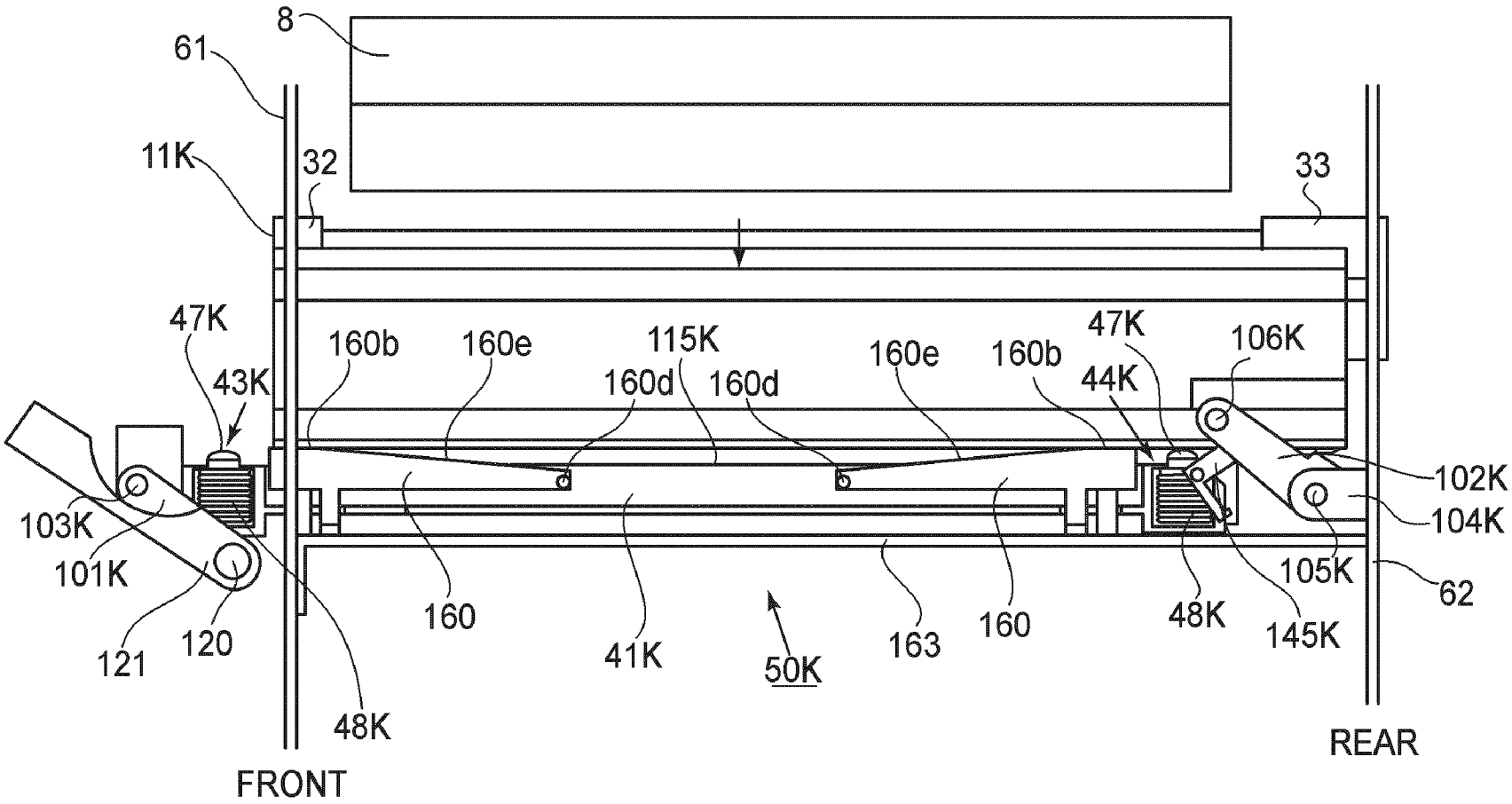
FIG. 15 is a schematic view for illustrating a cartridge holding constitution in a Second Embodiment.

FIG. 15 is a schematic view for illustrating a principal portion of a cartridge 11Y, 11M, 11C, 11K holding constitution of an image forming apparatus of the Second Embodiment. Specifically, FIG. 15 is a sectional view when a tray 41K is moved apart from an image formable portion to a second position in which a cartridge 11K is located at a detachably mountable portion with respect to an apparatus main assembly.

In this embodiment, a constitution of a guiding member is largely different from that of the image forming apparatus in the First Embodiment. The difference from the constitution of the First Embodiment will be principally described.

Compared with the constitution of the First Embodiment, in this embodiment, two (front and rear) guiding members 160 are prepared and are constituted so as to swing with a rotation center 160*d*. For this reason, a guiding surface is constituted by an inclined surface 160*e* and a guide surface 160*b* having the same height as an urging portion 47K.

When the cartridge 11K is detached or inserted, the cartridge 11K gently goes up the inclined surface 160*e* from the tray surface 115K and, after reaching the guide surface 160*b*, is received by the urging portion 47K.

The inclined surface 160*e* is designed to have a gentle angle of, e.g., about 5 degrees.

Even in such a constitution, compared with a conventional constitution, the fluctuation in the operating force can fall within a very small range. Further, compared with the First Embodiment, the guiding member 160 does not occupy a longitudinal portion of the tray 41K in the constitution of this embodiment. For this reason, it is also possible to implement another function at a longitudinal central portion of the tray 41K.

However, when the cartridge 11K goes up the inclined surface 160*e*, the operating force of the user is subjected to fluctuation.

Third Embodiment

A Third Embodiment will be described in detail with reference to the drawings.

Figure 16:
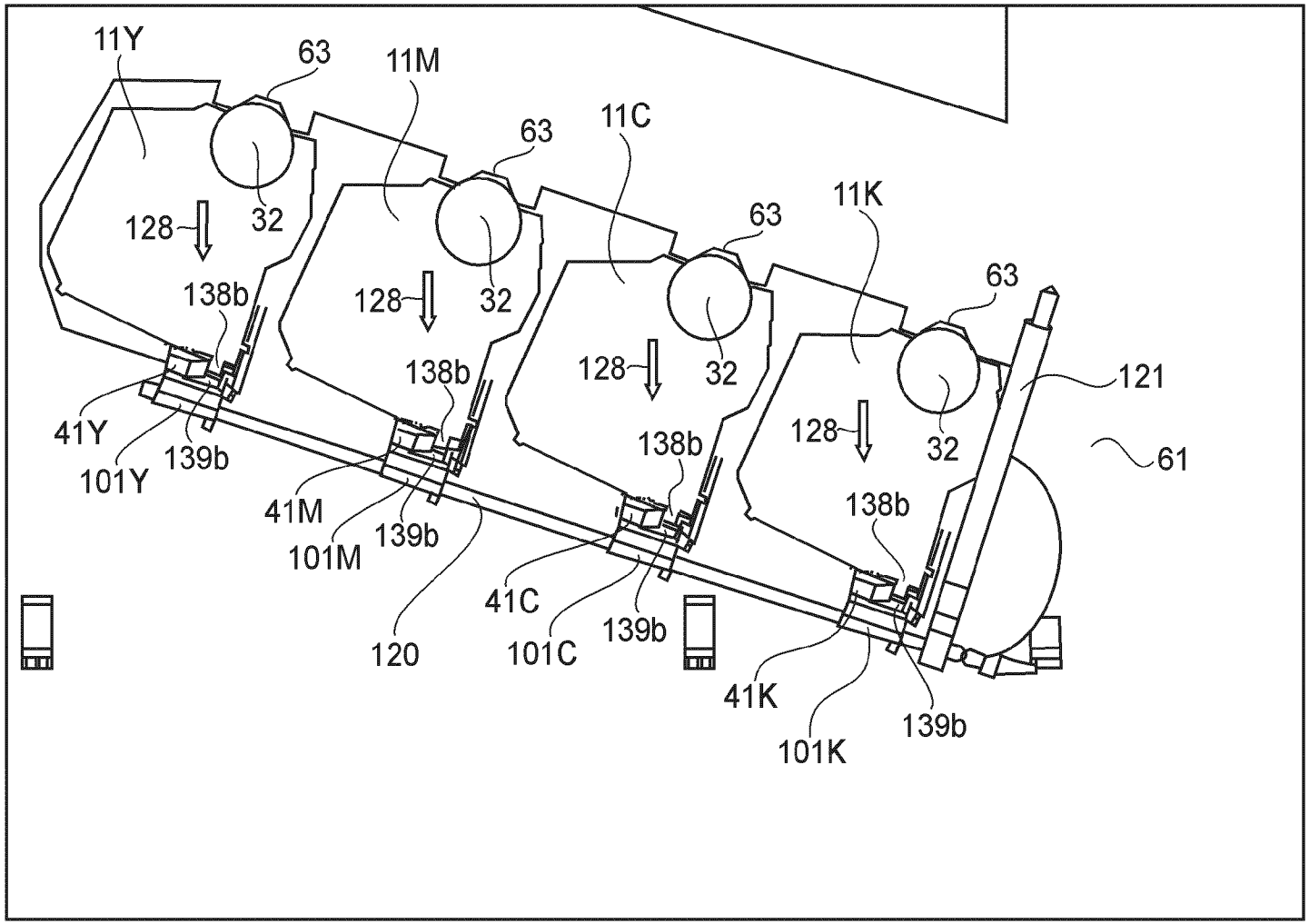
FIGS. 16 and 17 are schematic views for illustrating a cartridge holding constitution in a Third Embodiment.
Figure 17:
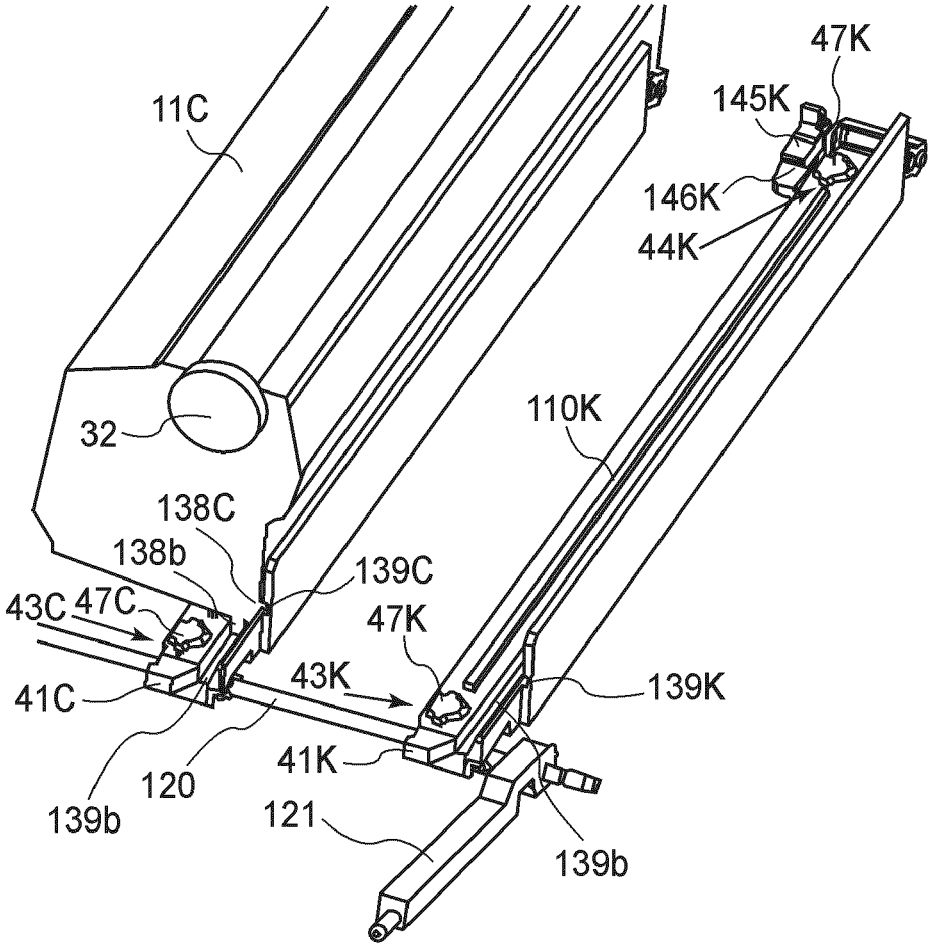

FIG. 16 is a schematic view for illustrating a principal portion of a cartridge holding constitution of an image forming apparatus of the Third Embodiment. Different points from the First and Second Embodiments will be principally described.

A feature in this embodiment is such that each of the cartridges 11Y, 11M, 11C, 11K is disposed obliquely, not horizontally. By obliquely disposing the cartridges 11Y, 11M, 11C, 11K, the weight of each of the cartridges 11Y, 11M, 11C, 11K is exerted in a direction of an arrow 128, so that its respective tray 41Y, 41M, 41C, 41K is constituted so that the load is spread to and borne by a bottom surface and a side surface of the respective cartridge 11Y, 11M, 11C, 11K.

For that reason, compared with the First Embodiment, the number of surfaces contacting the bottom surface is decreased and the number of surfaces contacting the side surface is increased.

Further, a rib 138*b* as a projection is provided to the cartridge 11Y, 11M, 11C, 11K and a groove portion 139*b* is provided to the tray 41Y, 41M, 41C, 41K, thus preventing falling of the cartridge 11Y, 11M, 11C, 11K. A link shaft 120 is obliquely disposed correspondingly to an inclination angle of the cartridge 11Y, 11M, 11C, 11K and a link lever 121 is also obliquely disposed similarly. Compared with the First Embodiment, the number of the surfaces corresponding to the bottom surface is decreased, so that a drum is capable of being irradiated with laser light without providing a slit opening to the tray 41Y, 41M, 41C, 41K.

Further, urging portions 47 of urging members 43 and 44, coil springs, and a guiding member 110 are changed in arrangement in correspondence with the oblique arrangement of the cartridges 11Y, 11M, 11C, 11K.

As described above, the present invention is applicable irrespective of the horizontal or oblique arrangement of the cartridges, so that the latitude in cartridge arrangement is wide and therefore the present invention is applicable to more image forming apparatus.

Fourth Embodiment

A Fourth Embodiment will be described in detail with reference to the drawings. Only portions different from the First Embodiment will be described.

Figure 19:
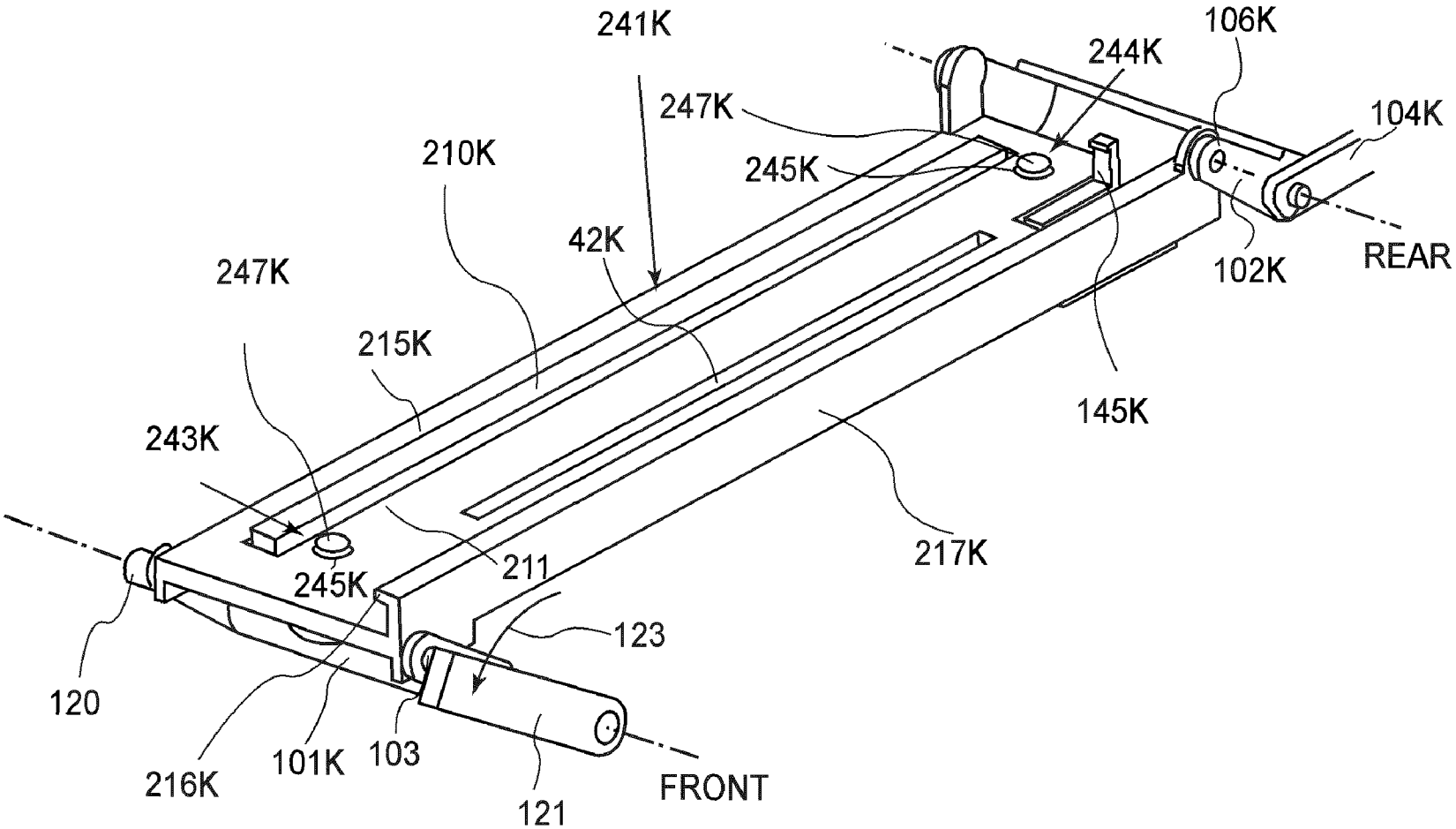
FIG. 19 is a perspective view of a lifting and lowering mechanism placed in a state in which a tray in a Fourth Embodiment is moved down to a second position.

FIG. 19 is a perspective view of a tray 241K which is movable member in this embodiment. In the First Embodiment, the guiding member is disposed between the urging members with respect to the mounting direction of the cartridge to the apparatus main assembly. However, in this embodiment, a guiding member 215K is disposed close to urging members 244K and 245K and is constituted to have a length longer than a distance between the urging members 244K and 245K. Also in this constitution, the same effect as in the above-described First Embodiment can be obtained.

Other Embodiments (i) In the above-described embodiments, a description has been provided based on the constitution of the image forming apparatus using the plurality of cartridges, but the present invention is also applicable to an image forming apparatus using a single cartridge.

(ii) The image forming method of the image forming apparatus is not limited to the electrophotographic image forming method but may also be an electrostatic recording image forming method using an electrostatic recording dielectric member as the image bearing member, a magnetic recording image forming method using a magnetic recording magnetic member, and the like.

(iii) The above-described embodiments are described by using the process cartridge, but a cartridge is not limited to the process cartridge if the cartridge is detachably mountable to the apparatus main assembly. For example, the cartridge may be a supply cartridge for supplying developer to the process cartridge.

According to the above-described constitutions of the present invention, it is possible to provide an image forming apparatus which has realized space saving of the mounting and demounting of the cartridge, has reduced the user operating force necessary to the mounting and demounting operation of the cartridge, and has improved the user operability.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 271237/2007 filed Oct. 18, 2007, and 243921/2008 filed Sep. 24, 2008, which is hereby incorporated by reference.

What is claimed is:

1. An image forming apparatus, to which a cartridge is detachably mountable, for forming an image on a recording material, said image forming apparatus comprising:

a positioning portion that positions the cartridge;

a movable member which is movable between a first position for positioning the cartridge to said positioning portion when the cartridge is mounted to a main assembly of said apparatus, and a second position, retracted from the first position, for permitting mounting of the cartridge to said main assembly of said apparatus in a longitudinal direction of the cartridge, wherein said movable member is provided with an urging member that urges and positions the cartridge to said positioning portion when said movable member takes the first position;

a guiding member movable relative to said movable member to take a guide position for guiding the cartridge when said movable member takes the second position and to take a spacing position retracted from the guide position away from the cartridge when said movable member takes the first position, wherein said guiding member projects through an opening provided in said movable member at the guide position.

2. An apparatus according to claim 1, wherein said movable member is provided with a plurality of said urging members, and wherein said guiding member is disposed between adjacent ones of said urging members with respect to a mounting direction in which the cartridge is mounted to said main assembly of said apparatus.

3. An apparatus according to claim 1, wherein when said guiding member takes the spacing position, said guiding member is retracted to a position flush with or retracted from a plane of said opening, and when said movable member takes the first position to urge said cartridge to said positioning portion, said urging member is projected out through a second opening in the plane.

4. An apparatus according to claim 3, wherein the distance said guiding member projects from the plane in the guide position is substantially the same as the distance said urging member projects from the plane when said movable member takes the second position.

5. An apparatus according to claim 1, wherein said urging member includes a spring, wherein an urging portion is provided at a free end of said spring, wherein said urging portion projects through an opening provided in said movable member, and is contacted by the cartridge when the cartridge is mounted to the main assembly of said apparatus.

6. An apparatus according to claim 1, wherein the cartridge is a process cartridge that includes a photosensitive member and a developing device that develops an electrostatic latent image formed on the photosensitive member, wherein said apparatus further comprising a belt, provided above said movable member, that transfers a developed image formed on the photosensitive member by the developing device, onto a recording material.

7. An apparatus according to claim 6, wherein when the process cartridge is mounted to said main assembly of said apparatus and said movable member takes the first position, the photosensitive member and said belt contact to each other, and when said movable member takes the second position, the photosensitive member and said belt are spaced from each other and the process cartridge is detachable and mountable relative to said main assembly of said apparatus.

8. An apparatus according to claim 7, wherein said moveable member includes a regulating portion that regulates movement of the process cartridge toward said belt by engagement with the process cartridge so that the process cartridge is prevented from contacting said belt when the process cartridge is mounted and demounted with said movable member taking the second position.

9. An apparatus according to claim 8, wherein said regulating portion includes an engaging portion engageable with a groove formed in the process cartridge.

10. An apparatus according to claim 9, wherein said regulating portion includes a groove engageable with a projected portion provided on the process cartridge.

11. An apparatus according to claim 1, wherein said guiding member includes a supporting portion, contactable with said main assembly of said apparatus, that positions said guiding member to the guide position when said movable member takes the second position.

12. An apparatus according to claim 11, wherein said supporting portion is spaced from said main assembly of said apparatus and is supported by said movable member when said movable member takes the first position.

13. An apparatus according to claim 1, wherein said apparatus includes a plurality of said movable members, and a plurality of process cartridges are detachably mountable to said apparatus.

14. An apparatus according to claim 1, wherein said movable member includes a thrust urging member that positions the cartridge relative to said main assembly of said apparatus with respect to the longitudinal direction, wherein said thrust urging member is rotatable for movement in a direction in which the cartridge is mounted to and demounted from the main assembly of said apparatus.

15. An apparatus according to claim 1, wherein said urging member includes urging members provided at each of front and rear sides of said movable member with respect to a mounting direction in which said cartridge is mounted to said main assembly of the apparatus, wherein said guiding member is disposed between said urging members at said sides.

* * * * *